US005983434A

United States Patent [19]

Eichinger et al.

[11] Patent Number: 5,983,434

[45] Date of Patent: Nov. 16, 1999

[54] ROTARY BRISTLE TOOL WITH PREFERENTIALLY ORIENTED BRISTLES

[75] Inventors: Marcus L. Eichinger, Fridley; Dean S. Holmes, St. Paul; David E. Johnson, Maplewood; Dennis W. Wilson, Burnsville, all of Minn.

[73] Assignee: Minnesota Mining and Manufacturing Company, St. Paul, Minn.

[21] Appl. No.: 08/892,756

[22] Filed: Jul. 15, 1997

[51] Int. Cl.[6] ..... A46B 1/00; A46B 13/00

[52] U.S. Cl. ..... 15/180; 15/179; 15/188; 15/207.2; 15/230.16; 451/465; 451/466; 451/532

[58] Field of Search ..... 15/141.2, 179, 15/180, 187, 188, 207.2, 213, 230, 230.14, 230.13, 230.16; 451/109, 465, 466, 532, 546, 913, 916

[56] References Cited

U.S. PATENT DOCUMENTS

| | | | |
|---|---|---|---|
| 1,910,444 | 5/1933 | Nicholson | 51/308 |
| 2,134,934 | 11/1938 | Wilhoit | 15/188 X |
| 3,041,156 | 6/1962 | Rowse et al. | 51/298 |
| 3,233,272 | 2/1966 | Pambello | 15/182 |
| 3,270,467 | 9/1966 | Block et al. | 451/509 |
| 3,470,575 | 10/1969 | Larson et al. | 15/188 X |
| 3,562,968 | 2/1971 | Johnson et al. | 451/521 |
| 3,667,170 | 6/1972 | MacKay, Jr. | 451/521 |
| 3,755,847 | 9/1973 | Liebscher | 15/187 X |
| 3,958,294 | 5/1976 | Thompson | 15/187 X |
| 4,311,489 | 1/1982 | Kressner | 51/298 |
| 4,314,827 | 2/1982 | Leitheiser et al. | 51/298 |
| 4,461,127 | 7/1984 | Hanger | 15/180 X |
| 4,623,364 | 11/1986 | Cottringer et al. | 51/309 |
| 4,652,275 | 3/1987 | Bloecher et al. | 51/298 |
| 4,744,802 | 5/1988 | Schwabel | 51/309 |
| 4,770,671 | 9/1988 | Monroe et al. | 51/293 |
| 4,799,939 | 1/1989 | Bloecher et al. | 51/293 |
| 4,875,259 | 10/1989 | Appeldorn | 24/576 |
| 4,881,951 | 11/1989 | Wood et al. | 51/309 |
| 4,964,883 | 10/1990 | Morris et al. | 51/293 |
| 4,997,461 | 3/1991 | Markhoff-Matheny et al. | 51/295 |
| 5,009,675 | 4/1991 | Kunz et al. | 51/295 |
| 5,009,676 | 4/1991 | Rue et al. | 51/309 |
| 5,011,508 | 4/1991 | Wald et al. | 51/293 |
| 5,042,991 | 8/1991 | Kunz et al. | 51/295 |
| 5,077,870 | 1/1992 | Melbye et al. | 24/452 |
| 5,164,348 | 11/1992 | Wood | 501/127 |
| 5,174,795 | 12/1992 | Wiand | 51/295 |
| 5,185,012 | 2/1993 | Kelly | 51/295 |
| 5,213,591 | 5/1993 | Celikkaya et al. | 51/293 |
| 5,232,470 | 8/1993 | Wiand | 51/295 |
| 5,233,794 | 8/1993 | Kikutani et al. | 451/546 |
| 5,244,477 | 9/1993 | Rue et al. | 51/293 |
| 5,372,620 | 12/1994 | Rowse et al. | 51/309 |
| 5,427,595 | 6/1995 | Pihl et al. | 51/298 |
| 5,443,906 | 8/1995 | Pihl et al. | 428/370 |
| 5,460,883 | 10/1995 | Barber, Jr. et al. | 428/370 |
| 5,500,273 | 3/1996 | Holmes et al. | 428/147 |
| 5,679,067 | 10/1997 | Johnson et al. | 451/527 |

FOREIGN PATENT DOCUMENTS

| | | | |
|---|---|---|---|
| 111483 | 9/1968 | Denmark | 15/179 |
| 148726 | 7/1985 | European Pat. Off. | 15/207.2 |
| 689655 | 6/1930 | France | 15/188 |
| 2913086 | 5/1980 | Germany | 451/466 |
| 290515 | 5/1928 | United Kingdom | 15/188 |
| 2 043 501 | 10/1980 | United Kingdom . | |
| 96/33638 | 10/1996 | WIPO . | |

*Primary Examiner*—Mark Spisich
*Attorney, Agent, or Firm*—James J. Trussell

[57] ABSTRACT

A rotary bristle tool having a backing with a plurality of bristles extending therefrom. The bristles have a cross section and preferential orientation to control deflection during rotation of the tool. One embodiment is well suited for refining the inside surface of two-way and three-way corners. The backing and bristles are preferably integrally molded. The rotary bristle tool is molded from a moldable polymer such a thermoset polymer, thermoplastic polymer, or thermoplastic elastomer. The rotary bristle tool can include an attachment member molded integrally with the backing. Also disclosed is a method of making a rotary bristle tool and a method of refining a workpiece surface with a rotary bristle tool.

55 Claims, 6 Drawing Sheets

ROTARY BRISTLE TOOL WITH PREFERENTIALLY ORIENTED BRISTLES

TECHNICAL FIELD

The present invention relates generally to a rotary bristle tool having a plurality of preferentially oriented bristles extending from a the backing, and more particularly to an integrally molded rotary bristle tool in which the cross section and orientation of the bristles provides for desired deflection during operation of the rotary bristle tool.

BACKGROUND OF THE INVENTION

Brushes have been used for many years to polish, clean and abrade a wide variety of substrates. These brush products typically have a plurality of bristles that contact the substrate. Abrasive particles can be added to bristles to increase their abrasiveness.

U.S. Pat. No. 3,233,272, "Rotary Brush," (Pambello), discloses brushes, particularly rotary brushes of the annularly or spirally arranged brush strip type which are primarily adapted for heavy duty such as brushing paved streets, sidewalks, concrete flooring and the like. In one embodiment, the rotary brush of Pambello comprises a rotatable structure, a brushing element formed of a unitary strip of yieldable plastic material annularly arranged on the structure, the strip having a lengthwise extending base and having vane means extending outwardly from the base and formed with a tip at the outer end thereof. The brush strip of Pambello may be formed of plastic materials by molding or extruding and cutting operations.

U.S. Pat. No. 5,233,794, "Rotary Tool Made of Inorganic Fiber-Reinforced Plastic," (Kikutani et al.), discloses a rotary tool 5 having a rotating tip formed integrally with a shaft 3. The rotary tool is formed of a thermosetting resin containing inorganic long fibers with a high degree of hardness as an abrasive means in an amount from 50% to 81% by volume. The long inorganic fibers can have a diameter in the range of 3 $\mu$m to 30 $\mu$m. In one of the embodiments of Kikuluani et al., the rotating tip is formed as a column or cylinder with elements which correspond to the bristle of a brush extending from the tip.

It is known to form various types of abrasive filaments from thermoplastic elastomers. U.S. Pat. No. 5,427,595 (Pihl) discloses an extruded abrasive filament including a first elongate filament component having a continuous surface throughout its length and including a first hardened organic polymeric and a second elongate filament component coterminous with the first elongate filament component, including a second hardened organic polymeric material in melt fusion adherent contact with the first elongate filament component along the continuous surface. The second hardened organic polymeric material can be the same or different than the first hardened organic polymeric material. At least one of the first and second hardened organic polymeric materials includes a thermoplastic elastomer having abrasive particles adhered therein. Also disclosed is an abrasive article comprised of at least one abrasive filament mounted to a substrate such as a hub adapted to be rotated at a high rate of revolution.

U.S. Pat. No 5,460,883 (Barber) discloses a composite abrasive filament which includes at least one preformed core at least partially coated with a thermoplastic elastomer having abrasive particles dispersed and adhered therein, the thermoplastic elastomer and abrasive particles together comprising a hardened composition. The composite abrasive filament has a hardened composition over at least a portion, preferably over the entire surface of at least one preformed core. The preformed core is formed in a step separate from and prior to one or more coating steps, one of which coats the preformed core with abrasive-filled thermoplastic elastomer.

U.S. Pat. Nos. 5,174,795 and 5,232,470 (Wiand) teach a planar abrasive article comprising a sheet portion with a plurality of protrusions extending therefrom. Abrasive particles are homogeneously dispersed throughout the moldable material comprising the article. Wiand teaches one embodiment having short protrusions extending 1.6 mm (0.063 in) from the backing and having a 3.2 mm (0.125 in) diameter, and another embodiment having short protrusions extending 1.3–1.5 mm (0.05–0.06 in) from the backing and having a 1.3 mm (0.05 in) diameter.

G.B. Patent Application No. 2.043,501, (Dawkins) discloses an abrasive article for polishing ophthalmic workpieces. The abrasive article is made by injection molding a mixture of abrasive grains and a thermoplastic binder to form an abrasive article comprising a flexible backing having a plurality of upstanding projections, the ends of which act as operative abrading surfaces.

It is known to integrally mold bristles with the backing of a brush. U.S Pat. No. 5,679.067 issued Oct 21, 1997, discloses a molded abrasive brush having a backing with a plurality of bristles extending therefrom. The backing and bristles are preferably integrally molded. The brush is molded from a moldable polymer such a thermoset polymer, thermoplastic polymer, or thermoplastic elastomer. The moldable polymer includes a plurality of organic or inorganic abrasive particles interspersed throughout at least the bristles, and can be interspersed throughout the brush. The moldable brush can include an attaching means molded integrally with the backing. Johnson et al. discloses that the bristles may have any cross sectional area, including but not limited to, circular, star, half moon, quarter moon, oval, rectangular, square, triangular, diamond or polygonal. In one preferred embodiment, the bristles of Johnson et al. comprise a constant circular cross section along the length of the bristle. In other preferred embodiments of Johnson et al., the bristles have a non-constant or variable cross section along all or a portion of the length of the bristle. Similar brushes are also disclosed in WIPO International Patent Application Publication No. WO 96/33638. U.S. patent application Ser. No. 08/782,782, Holmes et al., filed Jan. 13, 1997, discloses similar brushes which additionally include knobs configured to engage with holes in a retainer nut.

ROLOC™ Bristle Brushes are commercially available from Minnesota Mining and Manufacturing Company, St. Paul, Minn. Such brushes are molded abrasive brushes having a backing with a plurality of bristles extending therefrom. The backing and bristles are integrally molded. The brush is molded from a thermoplastic elastomer and includes a plurality of abrasive particles interspersed throughout brush. The bristles have a circular cross section along the length of the bristle, and are tapered to be wider at the base than at the tip.

SUMMARY OF THE INVENTION

Although the commercial success of available ROLOC™ Bristle Brushes has been impressive, it is desirable to further improve the performance of such rotary tools. For example, it is desirable to control the amount of radial displacement of the bristles during operation, and to control the amount of permanent displacement of the bristles at rest after use. It is also desirable to provide a tool configuration which is convenient and effective for refining the inside surface of a two -way or three-way corner.

In one aspect, the present invention provides a first embodiment of a rotary bristle tool. The rotary bristle tool comprises a base including a first side, a second side, and a center of rotation; and an array of bristles extending from the first side of the base. Each of the bristles includes a root adjacent the base and a tip opposite the root, and the bristles comprise an elastomeric polymer. The array of bristles defines an array root outer diameter at the roots of the bristles and an array tip outer diameter at the tips of the bristles, and the ratio of the array root outer diameter to the array tip outer diameter is at least 2:1. In one preferred version of the above rotary bristle tool, the array is circular, and the array root and tip outer diameters are concentric with the base center of rotation. Optionally, the bristles can include a plurality of abrasive particles therein. Preferably, the bristles comprise a thermoplastic elastomer.

In another preferred embodiment of the above rotary bristle tool, the bristles include a root cross section and a tip cross section. The root cross section includes a root major thickness and a root minor thickness, and the ratio of the root major thickness to the root minor thickness is at least 2:1. The root major thickness is oriented at an angle of from −20° to +20° relative to a line extending from the base center of rotation to the root. In one preferred embodiment, the root major thickness is oriented along a line extending from the base center of rotation to the root.

In another preferred embodiment, the bristles have a bristle length from the root to the tip, and the ratio of the bristle length to the root minor thickness is at least 5:1.

In another preferred embodiment, the bristles are configured such that rotation of the rotary bristle tool about the base center of rotation at 1000 RPM causes the bristles to deflect such that the ratio of the array tip outer diameter to the array root outer diameter is at least 1:1. Still more preferably, the bristles are configured such that rotation of the rotary bristle tool about the base center of rotation. at 3000 RPM causes the bristles to deflect such that the ratio of the array tip outer diameter to the array root outer diameter is at least 1.5:1.

In another preferred embodiment, the bristles are configured such that rotation of the rotary bristle tool about the base center of rotation at 2000 RPM causes the bristles to deflect such that the ratio of the array tip outer diameter during rotation to the array tip diameter at rest is at least 1.5:1.

In another preferred embodiment, the bristles are configured such that upon rotation of the rotary bristle tool about the base center of rotation at a sufficiently high rotational speed to cause the bristles to deflect such that the array tip outer diameter under rotation is at least to times the array tip outer diameter at rest, the tangential component of deflection at the tips is greater than the radial component of deflection at the tips. Still more preferably, the ratio of the tangential component of deflection at the tips to the radial component of deflection at the tips is at least 3:1.

In another preferred embodiment of the above rotary bristle tool, the bristles are integrally molded with the base. Preferably, the bristles and base comprise a thermoplastic elastomer.

Another aspect of the present invention presents a second embodiment of a rotary bristle tool. The rotary bristle tool comprises a base including a first side, a second side, and a center of rotation. A plurality of bristles extend from the first side of the base, and the bristles comprise a moldable polymer. Each of the bristles includes a root adjacent the base, a tip opposite the root, and a length from the root to the tip. The bristles include a root cross section and a tip cross section. The root cross section includes a root major thickness and a root minor thickness, and the ratio of the root major thickness to the root minor thickness is at least 1.5:1. The root major thickness is oriented at an angle of from −20° to +20° relative to a line extending from the base center of rotation to the root. The ratio of the bristle length to the root major thickness is at least 5:1.

In one preferred embodiment of the above rotary bristle tool, the bristles include an inboard side facing the base center of rotation, an outboard side facing away from the base center of rotation, and first and second sides opposite to one another and extending from the inboard side to the outboard side. At least at the bristle root, the inboard side has a first radius of curvature and the outboard side has a second radius of curvature, and the ratio of the first radius of curvature to the second radius of curvature is at least 2:1. Preferably, there is a smooth transition from the inboard side to the first and second sides and from the outboard side to the first and second sides. Optionally, the bristles include a plurality of abrasive particles therein.

Still another aspect of the present invention presents a third preferred embodiment of a rotary bristle tool. The rotary bristle tool comprises a base including a first side, a second side, and a center of rotation. An array of bristles extend from the first side of the base. The bristles comprise a moldable elastomeric polymer. Each of the bristles includes a root adjacent the base, a tip opposite the root, and a length from the root to the tip. The root includes a root cross section including a root major thickness and a root minor thickness. The ratio of the bristle length to the root minor thickness is at least 4:1. The array defines an array tip outer diameter at the tips of the bristles. The bristles are configured such that upon rotation of the rotary bristle tool about the base center of rotation at a sufficiently high rotational speed to cause the bristles to deflect to an array tip outer diameter under rotation that is at least two times the array tip outer diameter at rest, the ratio of the tangential component of deflection to the radial component of deflection is at least 3:1.

The materials, manufacturing process and rotary bristle tool configuration will depend upon the desired refining application. As used herein, the term "refine" includes at least one of the following: remove a portion of a workpiece surface; impart a surface finish to a workpiece; clean a workpiece surface, including removing paint or other coatings, gasket material, corrosion, or other foreign material; or some combination of the foregoing. In some applications, it may be preferred to provide aggressive abrasive characteristics, in which case the rotary bristle tool may comprise larger size abrasive particles, harder abrasive particles, a higher abrasive particle to binder ratio, or some combination of the above. In other applications, it may be preferred to provide a polish type finish to the surface being refined, or to clean a surface without removing surface material itself, in which case the rotary bristle tool may employ no abrasive particles, smaller abrasive particles, softer abrasive particles, lower particle to binder ratio, or some combination of the above. It is possible to employ abrasive particles of varied composition and hardness to obtain the desired abrading characteristics.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

Figure 1:
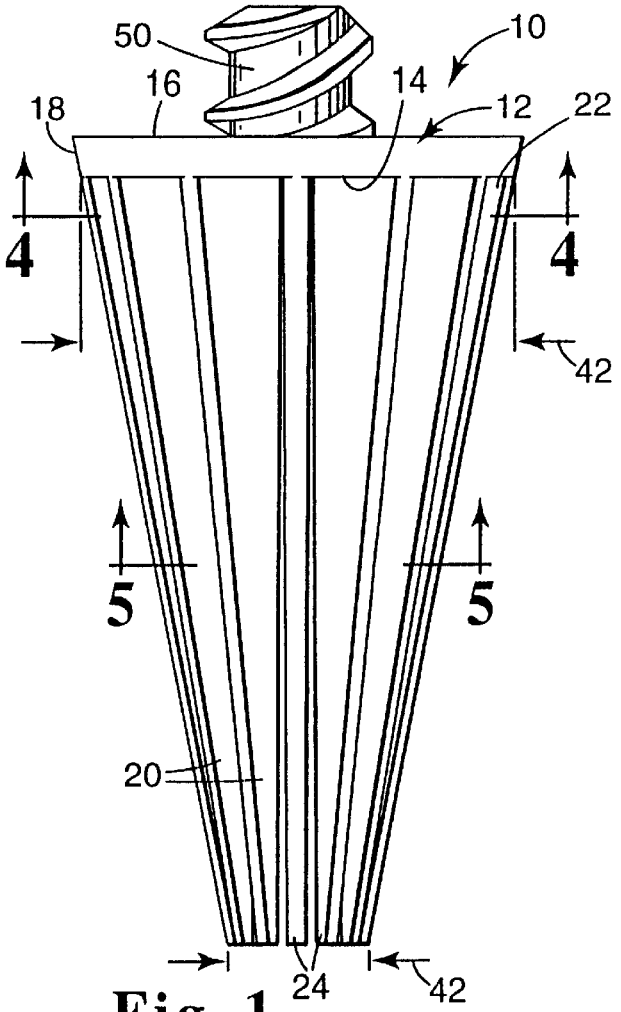
FIG. 1 is an elevational view of a first preferred embodiment of a rotary bristle tool according to the present invention.

Referring to FIGS. 1–7, a first preferred embodiment of a rolary bristle tool 10 is illustrated. While this embodiment is useful for many applications, it is particularly well suited for refining the inside surface of two-way and three-way corners.

Rotary bristle tool 10 comprises a generally planar base 12 having first side 14, second side 16, and outer periphery 18. A plurality of bristles 20 project outwardly from first side 14 of base 12. In between bristles 20 there are spaces in which the first side 14 of the base 12 is exposed. In one embodiment, rotary bristle tool 10 comprises a moldable polymer 13 substantially free of abrasive particles. In another embodiment, rotary bristle tool 10 comprises abrasive particles 11 in moldable polymer 13. Abrasive particles, when present, are preferably at least in the tips of the bristles, and more preferably throughout the bristles. Abrasive particles can also be present throughout the rotary bristle tool 10. Preferably, the base 12 is molded integrally with the bristles 20 to provide a unitary rotary bristle tool. Thus, no adhesive or mechanical means is required to adhere the bristles 20 to the base 12. It is preferred that the base 12 and bristles 20 are molded simultaneously.

Figure 2:
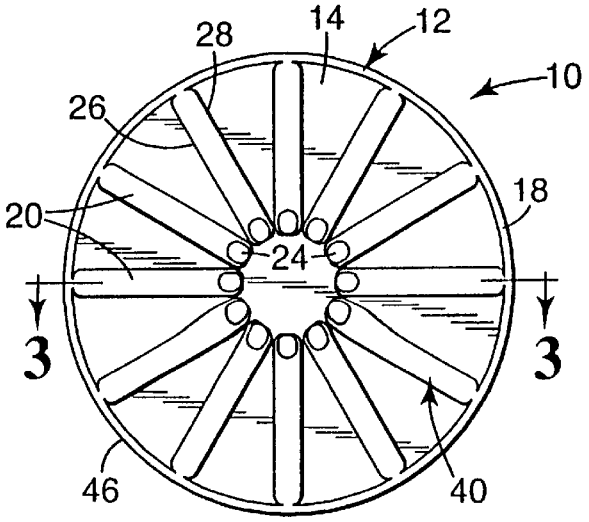
FIG. 2 is a bottom plan view of the rotary bristle tool of FIG. 1.
Figure 3:
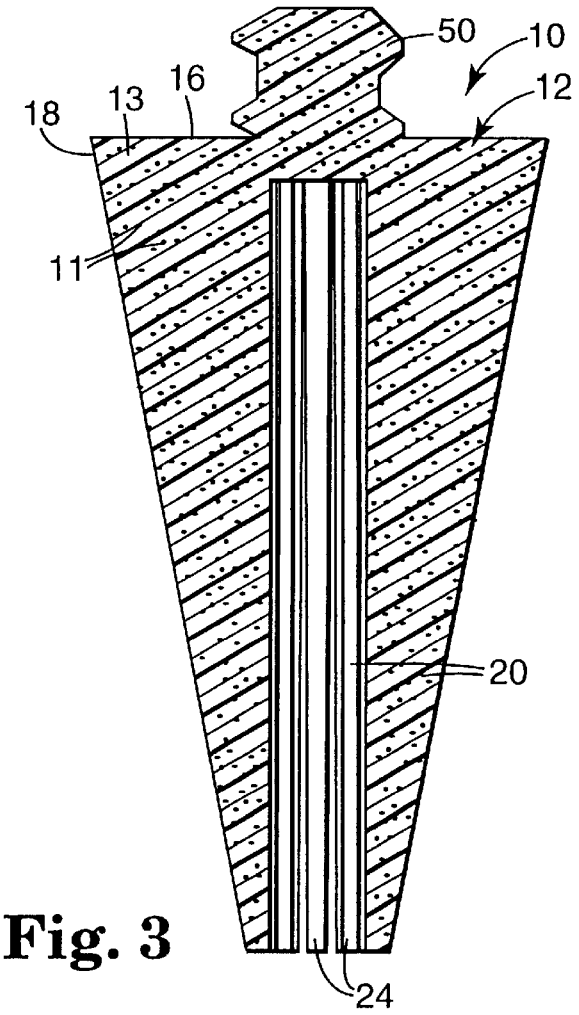
FIG. 3 is a cross section of the rotary bristle tool taken along line 3—3 of FIG. 2.

In a preferred embodiment, the base 12 is generally planar. However, it is within the scope of the invention to have a contoured or curved base. For example, base 12 may be convex, concave, or conical in shape. In such an arrangement, the bristles 20 may be of uniform length in which case tips 24 of the bristles will not be coplanar, or bristles may be of varying length in which case the tips may be coplanar. The base 12 may optionally contain a lip around its periphery 18 where a portion of the base extends radially beyond the bristles 20. The size of the lip is preferably minimized so that it does not interfere with maneuvering the rotary bristle tool 10 against surfaces bounding and at an angle relative to the surface of the workpiece. Base 12 is preferably circular as illustrated in FIG. 2. Base shapes other than circular are within the scope of the invention, including, but not limited to, oval, rectangular, square, triangular, diamond, and other polygonal shapes.

As will be discussed in detail below, rotation of the rotary bristle tool 10 will impart centrifugal force on the bristles 20. This would tend to bend the base 12 such that the first surface 14 would be convex. Therefore, the base 12 preferably is of a suitable material and thickness to provide a base 12 which substantially resists bending during operation. It is understood, however, that a small amount of bending during operation is acceptable, and in some applications may be preferred. Alternatively, it may be advantageous during some applications to allow base 12 to bend significantly during use.

The bristles 20 extend from the first side 14 of base 12, with root 22 adjacent the base 12 and tip 24 remote from the base 12. The bristles 20 have a cross section that provides preferential bending characteristics depending on the direction of bending. The configuration of the bristles controls the displacement of the bristles during use of the rotary tool 10. Preferably, the cross section of the bristles allows the bristles to bend more in one direction than in another direction.

Figure 4:
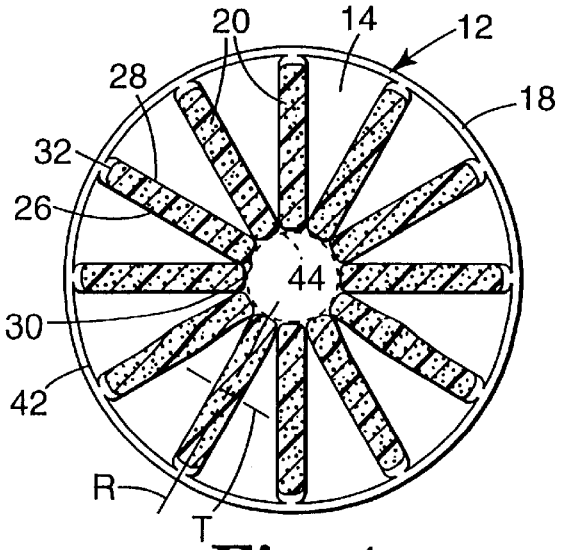
FIG. 4 is a cross section of the rotary bristle tool taken along line 4—4 of FIG. 1.

In one preferred embodiment illustrated in FIG. 4, the bristle cross section is oriented such that the bristle is more flexible in the tangential direction T than in the radial direction R. In the illustrated embodiment, bristle 20 includes a first side 26 and second side 28 generally opposite one another. Bristle 20 also includes an inboard side 30 and an outboard side 32 generally opposite one another. Inboard side extends between first and second sides 26, 28 at their inner radial ends. Outboard side 32 extends between first and second sides 26, 28 at their outer radial ends. The sides of the bristle are shown as generally planar, but any or all of them can be curved. Preferably, there is a fillet radius at the juncture of each of the sides. As illustrated, the first and second sides 26, 28 and the inboard and outboard sides 30, 32 are discrete adjacent portions. It is also within the scope of the invention for the sides to transition more smoothly from one to the next, without there being such a discrete distinction between them. In the illustrated embodiment, the cross section of bristle 20 is significantly longer in the radial direction than in the tangential direction. This provides a preferential flexibility to the bristle 20 such that it is more flexible in the tangential direction T than in the radial direction R.

To achieve the desired deflection of the bristles in one direction relative to the other, it is preferred that at the root, the ratio of the root major thickness to the root minor thickness is preferably at least 1.5:1, more preferably at least 2:1, and most preferably approximately 3.1. As used herein, including the claims, the term "major thickness" means the longest dimension of the cross section in the direction of greatest stiffness of the bristle, and the term "minor thickness" means the longest dimension of the cross section in the direction perpendicular to the direction of the greatest stiffness. In this illustrated embodiment, the major thickness extends in a radial direction relative to the base 12 and the minor thickness extends in the tangential direction. It is also within the scope of the invention to orient the major thickness in the tangential direction, or at any orientation between radial and tangential, depending on the deflection desired during operation of the rotary bristle tool 12.

In the illustrated embodiment, the bristle 20 is tapered such that the cross sectional area of the bristle 20 decreases from root 22 to tip 24. This is best seen in comparing the cross section of the root shown in FIG. 4, the cross section of the bristle mid way between the root 22 and tip 24 shown in FIG. 5, and the cross sectional shape of the bristle tip 24 shown in FIG. 2. Tapered bristles 20 tend to be easier to remove from the mold during fabrication of the rotary bristle tool than constant cross sectional area bristles 20. Furthermore, bristles 20 are subjected to bending stresses as rotary bristle tool 10 is rotated against a workpiece. These bending stresses are highest at the root 22 of bristles 20. Tapered bri,tles are better able to withstand such bending stresses. Tapered bristles are also more flexible near the tip 24 than near the root 22, which is desired for many applications of the rotary bristle tool 10.

Figure 5:
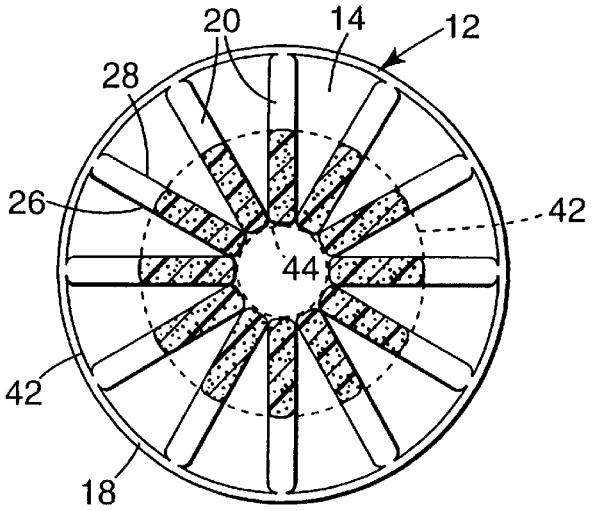
FIG. 5 is a cross section of the rotary bristle tool taken along line 5—5 of FIG. 1.

The bristles taper can be specified with respect to the outer diameter 42 and inner diameter 44 defined by the array 40 of bristles 20. As illustrated in FIG. 1, the outer diameter 42 at the root 22 of the bristles is greater than at the tip 24 of the bristles. This can also be seen by comparing FIG. 4, which shows the bristle cross section at the root; FIG. 5, which shows the bristle cross section approximately mid way between the root and tip; and FIG. 2, in which the tips of the bristles can be seen. Such a tapered configuration is particularly well suited for using the rotary bristle tool 10 of FIGS. 1–5 for refining the inside corner of two-way and three-way corners. The small outer diameter 42 at the tips allows the tool 10 to reach into the corner, while the taper to the large diameter at the roots provides strength to the bristles during high speed, high stress operation. In one preferred embodiment, the ratio of the outer diameter 42 of the array 40 at the root to that at the tip is at least 1.5:1, more preferably at least 2:1, and most preferably about 5:1.

For embodiments of tool 10 useful for refining inside corners, it is preferable to keep the inner diameter 44 of the bristle array 40 as small as possible. This may be limited by tool and mold geometry for making the tool 10. It is also rreferable that the array inner diameter 44 is constant from the root to the tip of the bristles 20, although this is not essential. An array tip inner diameter of up to 1.0 cm is preferred, although larger array tip inner diameters are within the scope of the invention. It is also possible to use bristles having a constant cross section from root to tip which do not have a taper.

For the embodiment of FIG. 1 which is well suited for refining inside corners, the diameter of base 12 is preferably from about 1.0 to 8.0 cm, although smaller and larger bases are also contemplated. The base 12 can preferably have a thickness of from about 1.0 to 8.0 mm, depending on the intended application, although thinner and thicker bases may also be used. In the embodiment illustrated in FIG. 1, the base 12 of the tool 10 has a diameter of about 2.5 cm and a thickness of about 2.0 mm, with twelve bristles extending from the first side of the base. The bristles each have a length of about 4.2 cm from the root to the tip, are approximately 5.0 mm long in the radial direction, 1.75 mm thick in the tangential direction, and taper to a circular cross section of 1.25 mm diameter. The array root outer diameter is about 2.5 cm, and the array tip outer diameter is about 0.9 cm. These dimensions are merely exemplary of one preferred embodiment, and do not thereby limit the claimed invention.

Figure 6:
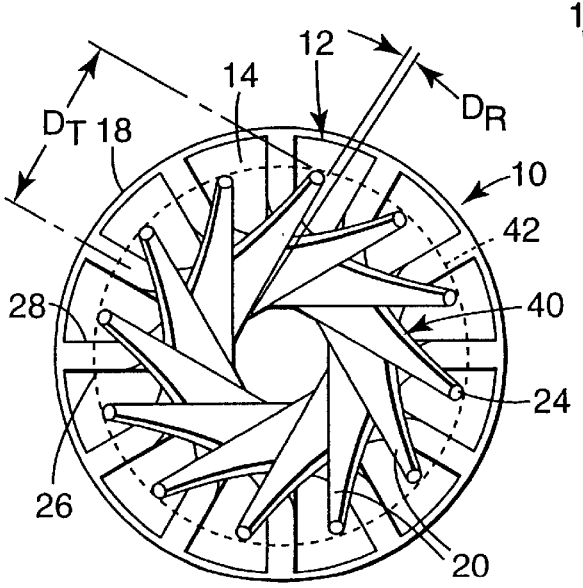
FIG. 6 is a bottom plan view of the rotary bristle tool of FIG. 1 showing the deflection of the bristles during rotation of the tool.
Figure 7:
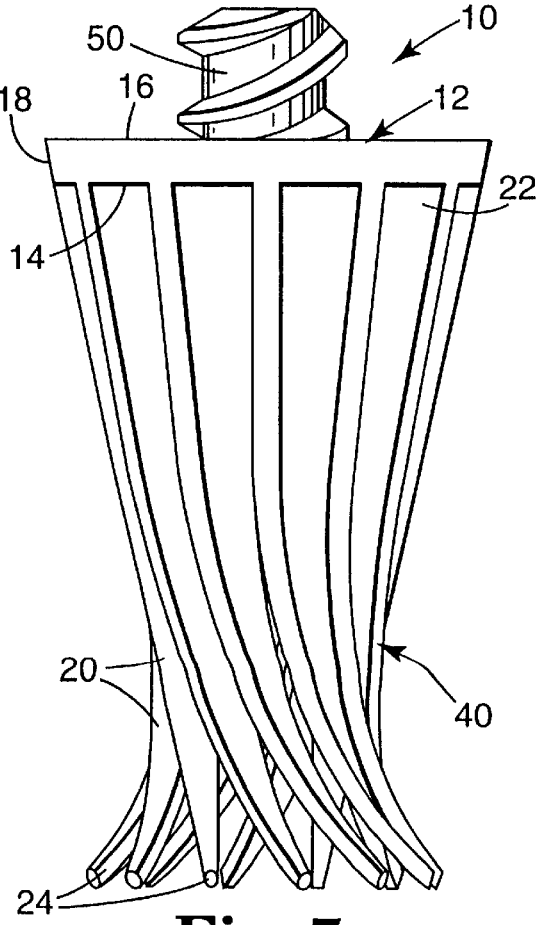
FIG. 7 is an elevational view of the rotary bristle tool of FIG. 1 showing the deflection of the bristles during rotation of the tool.

FIGS. 6 and 7 illustrate the deflection of the bristles 20 of the rotary bristle tool of FIGS. 1–5. It is seen that the tips 24 deflect such that the array outer diameter 42 at the tip is greater during operation than at rest. It is also seen that the bristles 20 30 deflect by bending primarily in the tangential direction. Accordingly, for each respective bristle, the tangential component, $D_T$, of the deflection at the tip is greater than the radial component, $D_R$, of deflection. This is because the bristles are oriented with the root major thickness in the radial direction and the root minor thickness in the tangential direction. Such a deflection results in the tip 24 of the bristles being located a significantly larger radius than would be expected from the magnitude of radial component of deflection, $D_R$ by itself without the tangential component, $D_T$. Such an orientation reduces radial component of the bristle bending as compared to a cylindrical bristle of similar cross sectional area. This helps reduce the amount of permanent radial deflection in the bristles that may result from high speed operation. In one preferred embodiment, the root major thickness is oriented at an angle of from −20° to +20° relative to a line extending from the center of rotation of the base 12 to the root of the bristle. More preferably, the root major thickness is oriented along the radial line. To achieve the desired flexibility, the ratio of the bristle length to the root minor thickness is preferably at least 2:1, more preferably at least 4:1, and still more preferably at least 10:1, depending on the bristle configuration and material, and on the intended application.

In one preferred embodiment, rotation of the rotary bristle tool 10 at a sufficiently high rotational speed to cause the array tip outer diameter under rotation to be at least two times the array tip outer diameter at rest, will cause the bristles to deflect such that the tangential component of deflection is larger than the radial component of deflection. It is more preferred that such at such a rotary speed, the ratio of the tangential component of deflection at the tip to the radial component is at least 3:1. Preferably, such deflection (caused only by rotation, not by contact with a workpiece surface) is primarily, if not completely, elastic. However, after use of the tool to actually refine a surface, it has been observed that the bristles may take on a certain amount of plastic deformation, primarily in the tangential direction.

For embodiments of tool 10 useful for refining inside corners, it is desirable to keep the tip outer diameter small enough to reach into corners, while allowing the bristles to deflect sufficiently under rotation such that the tips impart a high pressure against the surface being refined. In one preferred embodiment, rotation of the rotary bristle tool 10 at 2000 RPM causes the bristles to deflect such that the ratio of the tip outer diameter during rotation to the tip outer diameter at rest is at least 1.5:1. In one preferred embodiment, in which the ratio of the array outer diameter at the root to the array outer diameter at the tip is at least 2:1 while the tool is at rest, rotation of the tool 10 at approximately 1000 RPM causes the bristles to deflect such that the ratio of the array tip outer diameter to the array root outer diameter is at least 1:1. For such an embodiment, it is also preferred that rotation of the tool 10 at 3000 RPM causes the bristles to deflect such that the ratio of the array tip outer diameter to the array root outer diameter is at least 1.5:1. Preferably, the deflections just described are primarily, if not completely, elastic.

Bristle 20 preferably includes a fillet radius at the transition between the root 22 of the bristle 20 and the first surface 14 of the base. Fillet 24 can have a radius of from about 0.25 to 2.5 mm (0.010 to 0.100 in), and more preferably from about 0.5 to 1.3 mm (0.020 to 0.050 in).

Figure 8:
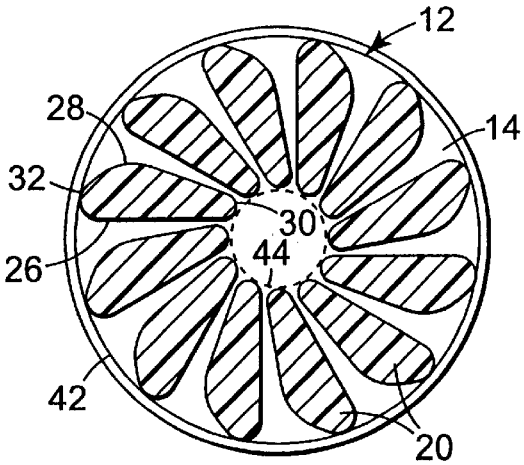
FIG. 8 is a cross section of an alternate bristle embodiment, taken at the root of the bristle.
Figure 9:
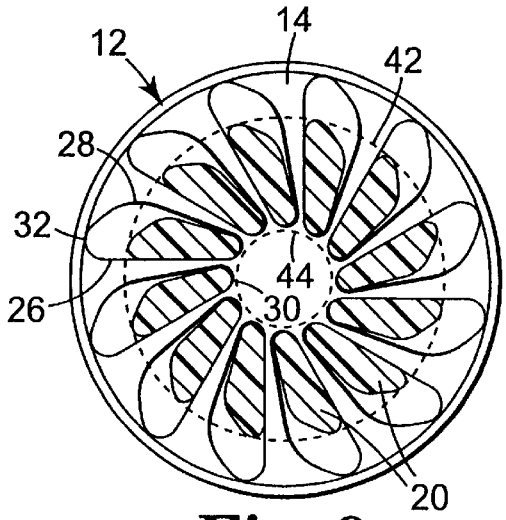
FIG. 9 is a cross section of the alternate bristle of FIG. 8 taken approximately mid-way between the root and tip of the bristle.

FIGS. 8-9 illustrate an alternate embodiment of the bristle cross section useful with the present invention. FIG. 8 illustrates the root cross section, while FIG. 9 illustrates the cross section midway between the root and tip First side 26 of the bristle 20 is generally linear, while second side 28 opposite the first side is convex. Inboard side 30 is curved, and transitions smoothly with the innermost portions of first and second sides 26, 28. Outboard side 32 is also curved, and transitions smoothly with the outermost portions of the first and second sides 26, 28. Such a cross section provides a bristle that is less flexible in the radial direction than the bristle illustrated in FIGS. 2, 4, and 5. The root cross section of the bristle of FIG. 8 has a root major thickness oriented in a generally radial direction, with the root minor thickness generally in the tangential direction. Because of the increased root minor thickness relative to the embodiment of FIG. 4, the root cross section of FIG. 8 has a lower ratio of root major thickness to root minor thickness than the root cross section of FIG. 4. This will reduce the tangential component of deflection relative to the cross section of FIG. 4, assuming all other relevant factors are the same.

The bristles of the present invention may taper to a circular cross section at tip 24, as illustrated in FIG. 2. For such an embodiment, the tip cross section has a major thickness and minor thickness both equal to the diameter of the tip, without a preferential orientation. It is also possible for the bristle tip to taper to a tip cross section having a discrete tip major thickness and tip minor thickness having a preferential orientation. Depending on the bristle geometry and the desired flexibility and deflection, the tip major thickness may or may not be parallel to the root major thickness.

Figure 10:
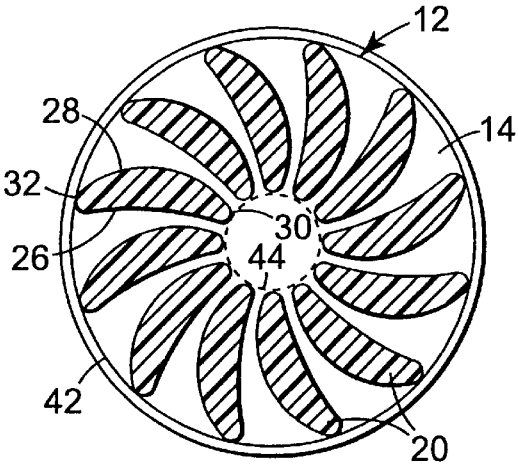
FIG. 10 is a cross section of a further alternate bristle embodiment, taken at the root of the bristle.
Figure 11:
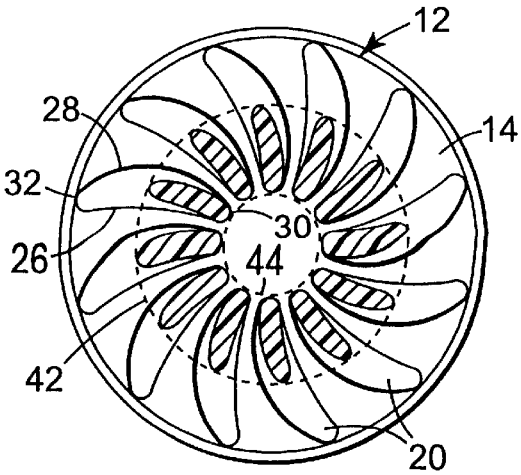
FIG. 11 is a cross section of the alternate bristle of FIG. 10 taken approximately mid-way between the root and tip of the bristle.

Still another embodiment is illustrated in FIGS. 10-11. FIG. 10 is a cross section at the root of the bristle, while FIG. 11 is a cross section approximately mid way between the root and tip of the bristle. The root major thickness of this embodiment extends in a generally radial direction, while the root minor thickness extends in a generally tangential direction. The root minor thickness of this embodiment s somewhat smaller than the root minor thickness of the embodiment of FIG. 8.

Figure 12:
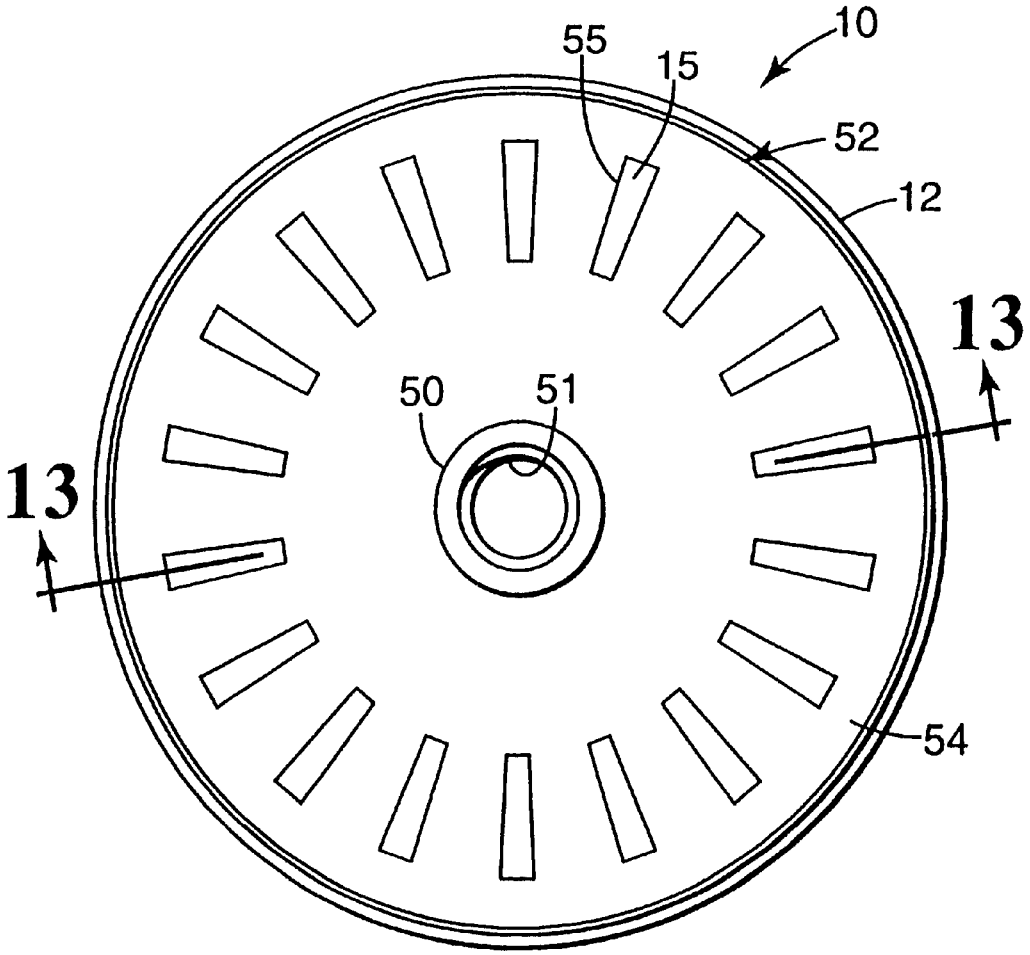
FIG. 12 is a top plan view of an alternate embodiment of a rotary bristle tool according to the present invention.
Figure 13:
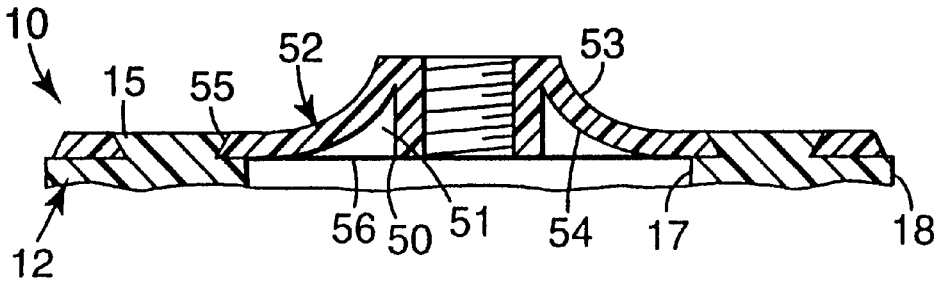
FIG. 13 is a cross section of the rotary bristle tool of FIG. 12 taken along line 13—13.
Figure 14:
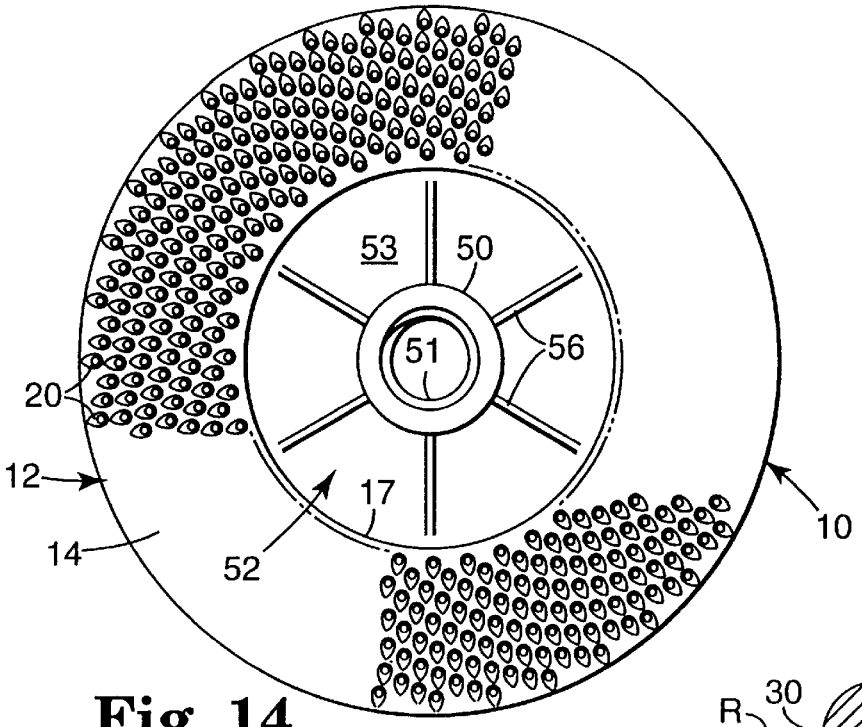
FIG. 14 is a bottom plan view of the rotary bristle tool of FIG. 12.

Another preferred embodiment of rotary bristle tool 10 is illustrated in FIGS. 12–14. As illustrated in FIG. 14, the bristles 20 are configured into a plurality of helical arcs or bristle curves and extend from the first side 14 of the base 12. The bristle curves each extend from near the inner edge 17 to near the outer edge 18 of the base 12. Each bristle 20 in the bristle curve is equally spaced from adjacent bristles 20 in the bristle curve. In one preferred arrangement, fifteen bristles 20 may be included in each bristle curve, and thirty-six bristle curves may be uniformly spaced around the second surface 14 of base 12. The bristles in each bristle curve are spaced radially to provide a generally continuous and uniform sweep by the bristle curve. In one preferred embodiment, the bristles 20 have a circular cross-section at the tip of about 0.05 inch diameter.

As best seen in FIGS. 12 and 13, this embodiment of rotary bristle tool 10 includes a reinforcing member 52 coupled to the second side 16 of backing 12. The reinforcing member extends outward to approximately the outer edge 18 of the base 12. The reinforcing member includes a plurality of openings 55 extending through the member. These openings have tapered walls such that the openings 55 are wider at the second side 54 of the reinforcing member 54 away from the base 12, and are narrower at the first side 53 of the reinforcing member adjacent the base. In a preferred embodiment, the reinforcing member is injection molded and allowed to harden. The reinforcing member is then placed in the mold for making the base 12, and the moldable polymer 13 is injected into the mold, filling the openings 55. Upon hardening of the moldable polymer 13 of the base 12, there is a secure mechanical attachment between the protrusions 15 of the base 12 which extend into the tapered openings 55 of the reinforcing member 52.

Figure 15:
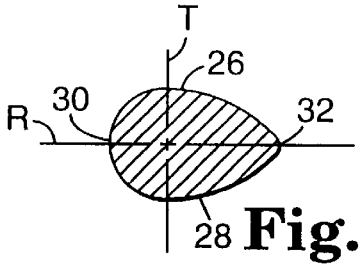
FIG. 15 is a cross sectional view of a preferred embodiment of an alternate bristle configuration according to the present invention.

In a preferred embodiment, the rotary bristle tool 10 of FIGS. 12–14 includes bristles 20 having a teardrop shaped cross section as seen in FIG. 15. Bristle 20 includes inboard side 30 which is in the shape of a portion of a circular arc. Opposite inboard side 30 is outboard side 32 which is also in the shape of a circular arc. Preferably, the ratio of the radius of curvature of the inboard side 30 to the radius of curvature of the outboard side 32 is at least 2:1, and more preferably at least 4:1. First side 26 and second side 28 extend between the outboard and inboard sides 30, 32. Preferably, there is a smooth transition from the inboard side to the first and second sides and from the outboard side to the first and second sides. As illustrated, the major thickness of the bristles of this embodiment extend in a radial direction, with the minor thickness extending in a tangential direction relative to base 12. This configuration provides additional resistance to the radial component of deflection, Such a bristle is less prone to plastic deformation in the radial deflection caused by high speed rotation of the rotary bristle tool 10. However, as with the previously described bristle embodiments, the major thickness can be oriented at any desired angle relative to the base 12, depending on the desired deflection and intended application of the rotary bristle tool 10.

The rotary bristle tool of FIGS. 12–14 preferably has a base diameter of from 1.0 to 20 cm, although smaller and larger bases are also within the scope of the invention. In the illustrated embodiment, the preferred diameter is about 11 cm. The thickness of the base is preferably from 1.0 mm to 1.0 cm. For one preferred embodiment of the bristle of FIG. 15, the inboard side 30 at root 22 is defined by a circle of 2.0 mm, with the root major thickness being about 3.3 mm, and the root minor thickness being about 2.0 mm. The bristle is approximately 19 mm long from root to tip, and tapers to a circular cross section of about 1.3 mm diameter.

It is understood that any bristles disclosed herein may be used with any base disclosed herein, and that any given rotary bristle tool may include more than one type of bristle thereon. Furthermore, the bristles 20 may have any cross sectional area, that provides preferential stiffness in different directions, including but not limited to, star, half moon, quarter moon, oval, rectangular, square, triangular, diamond or polygonal.

Attachment Member

Rotary bristle tool 10 preferably comprises attachment member to provide a means to secure the rotary bristle tool 10 to a rotary tool and/or a support pad or a back up pad during use. It is preferred that the attachment member 50 is molded integrally with the base and bristles. Preferred attachment member are described in U.S. Pat. Nos. 3,562,968; 3,667,170; and 3,270,467 the entire disclosures of all of which are incorporated herein by reference. Most preferred is the integrally-molded threaded stud adapted for screw-type engagement with a rotary tool as taught by U.S. Pat. No. 3,562,968, and as illustrated with respect to the embodiment of FIGS. 1–7. This type of attachment member is preferred for circular or disc shaped rotary bristle tool 10. It is preferred that the attachment member 50 be centered relative to the base 12 for proper rotation, and be adapted to attach the rotary bristle tool 10 to a high speed rotary tool, such as a right angle grinder, for example. Such an arrangement allows the rotary bristle tool 10 to be rotated at high speeds about an axis of rotation centered on the attachment member, and generally perpendicular to the base 12 (for flat, planar bases). In such an embodiment, each of the bristles 20 is translated in a circular path about the axis of rotation, while being oriented generally parallel to the axis of rotation. Preferably, the rotary bristle tool 10 and fastening means 50 are configured to be capable of being rotated at least 100 RPM, depending on the size and configuration, preferably at least 5000 RPM, and some smaller rotary bristle tools are capable of being rotated at up to 30,000 RPM. The attachment member 50 may be made from the same material as the rest of the rotary bristle tool 10, and may contain optional abrasive particles 11. Alternatively, the attachment member 50 may be made from a separate injection of moldable polymer 13 without abrasive particles 11.

Alternatively, the attachment means 50 may comprise one or more straight or threaded holes or openings through the base of the rotary bristle tool so that the rotary bristle tool may be mechanically secured (such as with a bolt and nut) to the back up pad. Such a hole may optionally be fitted with an insert of a different material than that of the base. FIGS. 12–14 illustrate one preferred embodiment in which the attachment means is a threaded hole 51 adapted for mounting on a threaded shaft.

It is also within the scope of this invention to use a hook and loop type attachment such as that taught in U.S. Pat. No. 5,077,870, "Mushroom-Type Hook Strip for a Mechanical Fastener," (Melbye et al.) or of the type commercially available as SCOTCHMATE™ from Minnesota Mining and Manufacturing Company, St. Paul, Minn. It is also possible to use a hermaphroditic fastener such as DUAL LOCK™ fastener, available from Minnesota Mining and Manufacturing Company, to secure the rotary bristle tool to a back up pad. It is also possible to employ intermeshing structured surfaces such as taught in U.S. Pat. No. 4,875,259, "Intermeshing Articles" (Appeldorn), the entire disclosure of which is incorporated herein by reference. Other useful attachment arrangements include those disclosed in U.S. patent application Ser. No. 08/782,782. Holmes et al., filed Jan. 13, 1997, the entire disclosure of which is incorporated herein by reference.

Any of the attachment means described herein may be used with any of the embodiments of the bristle tool 10 described herein.

Reinforcing Means

The base portion may further comprise reinforcing means. One preferred embodiment of a reinforcing means is the reinforcing member 52 discussed with respect to the embodiment of the rotary bristle tool 10 illustrated in FIGS. 12–14.

Alternatively, or additionally, the reinforcing means a can comprise, for example, a fiber reinforcing means such as fabric, non-woven sheeting, mesh, scrim, and the like, or can comprise individual fibers compounded into the moldable polymer and dispersed throughout the rotary bristle tool. The purpose of the reinforcing means is to increase the flexural strength and tensile strength of the backing. Examples of reinforcing fibers suitable for use in the present invention include glass fibers, metal fibers, carbon fibers, wire mesh, mineral fibers, fibers formed of heat resistant organic materials, or fibers made from ceramic materials. Other organic fibers include polyvinyl alcohol fibers, nylon fibers, polyester fibers and phenolic fibers. Glass fibers may preferably contain a coupling agent, such as a silane coupling agent, to improve the adhesion to the thermoplastic material. The length of the fiber will range from about 0.5 mm to about 50 mm, preferably about 1 mm to about 25 mm, most preferably about 1.5 mm to about 10 mm. The fiber denier will be between about 25 to 300, preferably between 50 to 200.

The reinforcing means may comprise a reinforcing layer or substrate to increase the strength of the base. It is not necessary to include abrasive particles in the reinforcing substrate, particularly if it does not contact the workpiece. The reinforcing substrate can comprise a moldable polymer. In this case, the reinforcing substrate can be molded at the same time as the rotary bristle tool 10. Alternatively, the reinforcing substrate can be a backing type material such as a polymeric film, primed polymeric film, cloth, paper, vulcanized fiber, nonwoven layer, and treated versions thereof. In this case, the reinforcing substrate can be inserted into the mold and the moldable polymer forming the rotary bristle tool can bond to the reinforcing substrate. Alternatively, the reinforcing substrate can be adhesively bonded to the rotary bristle tool 10 after the rotary bristle tool is molded. In one preferred embodiment, the reinforcing substrate is coextensive with the base 12, although it may be smaller or larger as desired.

Moldable Polymer

The moldable polymer 13 is preferably an organic binder material that is capable of being molded, i.e., it is capable of deforming under heat to form a desired shape. The moldable polymer may be a thermoplastic polymer, a thermosetting polymer, or a thermoplastic elastomer. Elastomeric polymers are preferred. As used herein, including the claims, the term "elastomeric polymer" is used to describe those materials whose mechanical properties emulate natural rubber insofar as that they stretch under tension, have a high tensile strength, react rapidly, and substantially recover their original dimensions. As used herein, elastomeric polymers include thermoplastic elastomers and thermoset elastomers. Thermoplastic e lastomers are particularly preferred.

In the case of a thermoplastic polymer, the organic binder is heated above its melting point which causes the polymer to flow. This results in the thermoplastic polymer flowing into the cavities of the mold to form the rotary bristle tool 10. The rotary bristle tool is then cooled to solidify the thermoplastic binder. In the case of a thermosetting polymer, during molding the organic binder is in a thermoplastic state, i.e., after it is heated above its melting point it will flow into the cavities of the mold to form the rotary bristle tool. Next, the rotary bristle tool is further heated, in some instances at a higher temperature, to cause this organic binder to crosslink and form a thermosetting polymer. Examples of suitable thermosetting polymers include styrene butadiene rubber, polyurethane, urea-formaldehyde, epoxy, and phenolics.

Thermoplastic Polymers

The rotary bristle tool according to the present invention may comprise a thermoplastic polymer. Examples of suitable thermoplastic polymers include polycarbonate, polyetherimide, polyester, polyethylene, polysulfone, polystyrene, polybutylene, acrylonitrile-butadiene-styrene block copolymer, polypropylene, acetal polymers, polyurethanes, polyamides, and combinations thereof. In general, preferred thermoplastic polymers of the invention are those having a high melting temperature and good heat resistance properties. Thermoplastic polymers may be preferably employed for low speed applications of rotary bristle tool 10, in which stress during operation is relatively low. Examples of commercially available thermoplastic polymers suitable for use with the present invention include Grilon™ CR9 copolymer of Nylon 6,12 available from EMS-American Grilon, Inc., Sumter S.C.; Profax™ and KS075 polypropylene based thermoplastic available from Himont USA, Inc., Wilmington, Del.; and Duraflex™ polybutylene based thermoplastic available from Shell Chemical Co., Houston, Tex.

Thermoplastic Elastomers

For many applications, such as high speed, high stress applications, it is preferred that the moldable polymer is a thermoplastic elastomer or includes a thermoplastic elastomer. Thermoplastic elastomers (or "TPE"s) are defined and reviewed in *Thermoplastic Elastomers, A Comprehensive Review*, edited by N. R. Legge, G. Holden and H. E. Schroeder, Hanser Publishers, New York, 1987 (referred to herein as "Legge et al.", the entire disclosure of which is incorporated by reference herein). Thermoplastic elastomers (as used herein) are generally the reaction product of a low equivalent weight polyfunctional monomer and a high equivalent weight polyfunctional monomer, wherein the low equivalent weight polyfunctional monomer has a functionality of at most about 2 and equivalent weight of at most about 300 and is capable on polymerization of forming a hard segment (and, in conjunction with other hard segments, crystalline hard regions, or domains) and the high equivalent weight polyfunctional monomer has a functionality of at least about 2 and an equivalent weight of at least about 350 and is capable on polymerization of producing soft, flexible chains connecting the hard regions or domains.

"Thermoplastic elastomers" differ from "thermoplastics" and "elastomers" (a generic term for substances emulating natural rubber in that they stretch under tension, have a high tensile strength, retract rapidly, and substantially recover their original dimensions) in that thermoplastic elastomers, upon heating above the melting temperature of the hard regions, form a homogeneous melt which can be processed by thermoplastic techniques (unlike elastomers), such as injection molding, extrusion, blow molding, and the like. Subsequent cooling leads again to segregation of hard and soft regions resulting in a material having elastomeric properties, however, which does not occur with thermoplastics. Thermoplastic elastomers combine the processability (when molten) of thermoplastic materials with the functional performance and properties of conventional thermosetting rubbers (when in their non- molten state), and which are described in the art as ionomeric, segmented, or segmented ionomeric thermoplastic elastomers. The segmented versions comprise "hard segments" which associate to form crystalline hard domains connected together by "soft", long, flexible polymeric chains. The hard domain has a melting or disassociation temperature above the melting temperature of the soft polymeric chains.

Commercially available thermoplastic elastomers include segmented polyester thermoplastic elastomers, segmented polyurethane thermoplastic elastomers, segmented polyamide thermoplastic elastomers, blends of thermoplastic elastomers and thermoplastic polymers, and ionomeric thermoplastic elastomers.

"Segmented thermoplastic elastomer", as used herein, refers to the sub-class of thermoplastic elastomers which are based on polymers which are the reaction product of a high equivalent weight polyfunctional monomer and a low equivalent weight polyfunctional monomer. Segmented thermoplastic elastomers are preferably the condensation reaction product of a high equivalent weight polyfunctional monomer having an average functionality of at least 2 and an equivalent weight of at least about 350, and a low equivalent weight polyfunctional monomer having an average functionality of at least about 2 and an equivalent weight of less than about 300. The high equivalent weight polyfunctional monomer is capable on polymerization of forming a soft segment, and the low equivalent weight polyfunctional monomer is capable on polymerization of forming a hard segment. Segmented thermoplastic elastomers useful in the present invention include polyester TPEs, polyurethane TPEs, and polyamide TPEs, and silicone elastomer/polyimide block copolyineric TPEs, with the low and high equivalent weight polyfunctional monomers selected appropriately to produce the respective TPE.

The segmented TPEs preferably include "chain extenders", low molecular weight (typically having an equivalent weight less than 300) compounds having from about 2 to 8 active hydrogen functionality, and which are known in the TPE art. Particularly preferred examples include ethylene diamine and 1,4-butanediol.

"Ionomeric thermoplastic elastomers" refers to a subclass of thermoplastic elastomers based on ionic polymers (ionomers). Ionomeric thermoplastic elastomers are composed of two or more flexible polymeric chains bound together at a plurality of positions by ionic associations or clusters. The ionomers are typically prepared by copolymerization of a functionalized monomer with an olefinic unsaturated monomer, or direct functionalization of a preformed polymer. Carboxyl-functionalized ionomers are obtained by direct copolymerization of acrylic or methacrylic acid with ethylene, styrene and similar comonomers by free-radical copolymerization. The resulting copolymer is generally available as the free acid, which can be neutralized to the degree desired with metal hydroxides, metal acetates, and similar salts. A review of ionomer history and patents concerning same is provided in Legge et al., pp. 231–243.

"Thermoplastic polymer", or "TP" as used herein, has a more limiting definition than the general definition, which is "a material which softens and flows upon application of pressure and heat." It will of course be realized that TPEs meet the general definition of TP, since TPEs will also flow upon application of pressure and heat. It is thus necessary to be more specific in the definition of "thermoplastic" for the purposes of this invention. "Thermoplastic", as used herein, means a material which flows upon application of pressure and heat, but which does not possess the elastic properties of an elastomer when below its melting temperature.

Blends of TPE and TP materials are also within the invention, allowing even greater flexibility in tailoring mechanical properties of the rotary bristle tools of the invention.

Commercially available and preferred segmented polyesters include those known under the trade designation "Hytrel™" such as "Hytrel™ 4056", "Hytrel™ 5526", "Hytrel™ 5556", "Hytrel™ 6356", "Hytrel™ 7246", and "Hytrel™ 8238" available from E.I. Du Pont de Nemours and Company, Inc., Wilmington, Del., with the most preferred including Hytrel™ 5526, Hytrel™ 5556, and Hytrel™ 6356. A similar family of thermoplastic polyesters is available under the tradename "Riteflex" (Hoechst Celanese Corporation). Still further useful polyester TPEs are those known under the trade designations "Ecdel", from Eastman Chemical Products, Inc., Kingsport, Tenn.; "Lomad", from General Electric Company, Pittsfield, Mass.; "Amitel" from DSM Engineered Plastics; and "Bexloy" from Du Pont. Further useful polyester TPEs include those available as "Lubricomp" from LNP Engineering Plastics, Exton, Penn., and is commercially available incorporating lubricant, glass fiber reinforcement, and carbon fiber reinforcement.

Commercially available and preferred segmented polyamides include those known under the trade designation "Pebax" and "Rilsan", both available from Atochem Inc., Glen Rock, N.J.

Commercially available and preferred segmented polyurethanes include those known under the trade designation "Estane", available from B.F. Goodrich, Cleveland, Ohio. Other segmented preferred segmented polyurethanes include those known under the trade designations "Pellethane", and "Isoplast" from The Dow Coming Company, Midland, Mich., and those known under the trade designation "Morthane", from Morton Chemical Division, Morton Thiokol, Inc.; and those known under the trade designation "Elastollan", from BASF Corporation, Wyandotte, Mich.

Thermoplastic elastomers are further described in U.S. Pat. No. 5,443,906, "Abrasive Filaments Comprising Abrasive-filled Thermoplastic Elastomers, Methods of Making Same, Articles Incorporating Same and Methods of Using Said Articles,"the entire disclosure of which is incorporated herein by reference.

Abrasive Particles

In embodiments which include the optional abrasive particles, the abrasive particles 11 typically have a particle size ranging from about 0.1 to 1500 micrometers, usually between about 1 to 1000 micrometers, and preferably betweeri 50 and 500 micrometers. The optional abrasive particles may be organic or inorganic.

Examples of abrasive particles include fused aluminum oxide, ceramic aluminum oxide, heated treated aluminum oxide, silicon carbide, titanium diboride, alumina zirconia, diamond, boron carbide, ceria, aluminum silicates, cubic boron nitride, garnet, and silica. Preferred fused aluminum oxides include those available commercially pretreated by Exolon ESK Company, Tonawanda, N.Y., or Washington Mills Electro Minerals Corp., North Grafton, Mass. Still other examples of abrasive particles include solid glass spheres, hollow glass spheres, calcium carbonate, polymeric bubbles, silicates, aluminum trihydrate. and mullite. Preferred ceramic aluminum oxide abrasive particles include those described in U.S. Pat. Nos. 4,314,827; 4,623,364; 4,744,802; 4,770,671; 4,881,951; 4,964,883; 5011,508; and 5,164,348, the contents of all of which are incorporated herein by reference. Preferred alpha alumina-based ceramic abrasive particles comprising alpha alumina and rare earth oxide include those commercially available under the designation Cubitron™ 321 from Minnesota Mining and Manufacturing Company, St. Paul, Minn. Also suitable for use with the present invention are shaped abrasive grains such as those taught in U.S. Pat. Nos. 5,009,676; 5,185,012; 5,244,477; and 5,372,620, the contents of all of which are incorporated herein by reference. The optional abrasive particles can be any particulate material (inorganic or organic) that when combined with the binder results in a rotary bristle tool 10 that can refine a workpiece surface. The selection of the abrasive material will depend in part on the intended application. For example, for stripping paints from a vehicle, it is sometimes preferred to omit abrasive particles from the rotary bristle tool 10. It is sometimes preferred to use a relatively soft abrasive particle when stripping paints so as not to damage the surface underneath the paint. Alternatively, for removing burs from metal workpieces, it is preferred to use a harder abrasive particle such as alumina. The rotary bristle tool of the present invention may include two or more types and/or sizes of abrasive particles in those embodiments that incorporate optional abrasive particles.

As used herein, the term abrasive particles also encompasses single abrasive particles which are bonded together to form an abrasive agglomerate. Abrasive agglomerates are further described in U.S. Pat. Nos. 4,311,489; 4,652,275; and 4,799,939, the disclosures of all of which are incorporated herein by reference. The abrasive particles of this invention may also contain a surface coating. Surface coatings are known to improve the adhesion between the abrasive particle and the binder in the abrasive article. Such surface coatings are described in U.S. Pat. Nos. 5,011,508; 1,910,444; 3,041,156; 5,009,675; 4,997,461; 5,213,591; and 5,042,991, the disclosures of all of which are incorporated herein by reference. In some instances, the addition of the coating improves the abrading and/or processing characteristics of the abrasive particle.

Organic abrasive particles suitable for use with the rotary bristle tool of the present invention are preferably formed from a thermoplastic polymer and/or a thermosetting polymer. Organic particles can also be made from natural organic materials such as walnut shells, wheat starch, and the like. Organic abrasive particles useful in the present invention may be individual particles or agglomerates of individual particles. The agglomerates may comprise a plurality of the organic abrasive particles bonded together by a binder to form a shaped mass.

When organic abrasive particles are used in the rotary bristle tool of the present invention, the particles are preferably present in the moldable polymer at a weight percent (per total weight of moldable polymer and organic abrasive particles) ranging from about 0.1 to about 80 weight percent, more preferably from about 3 to about 60 weight percent. The weight percentage depends in part on the particular abrading or rotary bristle tool applications.

The size of the organic abrasive particles incorporated into the moldable polymer depends on the intended use of the rotary bristle tool. For applications requiring cutting or rough finishing, larger organic abrasive particles are preferred, while particles having smaller size are preferred for finishing applications. Preferably, the average diameter of the particles is no more than about ½ the diameter of the bristle, more preferably no more than about ⅓ of the diameter of the bristle.

The organic abrasive particles preferably have an average particle size from about 0.01 to about 500 micrometers, typically between about 0.1 to about 250 micrometers, preferably between about 1 to about 150 micrometers, more referably between about 5 to about 100 micrometers and most preferably between about 5 to about 75 micrometers. The average particle size is typically measured by the longest dimension.

The organic abrasive particles can have any precise shape or can be irregularly or randomly shaped. Examples of such three dimensional shapes includes: pyramids, cylinders, cones, spheres, blocks, cubes, polygons, and the like. Alternatively, the organic abrasive particles can be relatively flat and have a cross sectional shape such as a diamond, cross, circle, triangle, rectangle, square, oval, octagon, pentagon, hexagon, polygon and the like.

The surface of the organic abrasive particles (a portion of their surface, or the entire surface) may be treated with coupling agents to enhance adhesion to and/or dispensability in the molten moldable polymer. The organic abrasive particles are not required to be uniformly dispersed in the hardened composition, but a uniform dispersion may provide more consistent abrasion characteristics.

The organic abrasive particles can be formed from a thermoplastic material such as polycarbonate, polyetherimide, polyester, polyvinyl chloride, methacrylate, methylmethacrylate, polyethylene, polysulfone, polystyrene, acrylonitrile-butadienestyrene block copolymer, polypropylene, acetal polymers, polyurethanes, polyamide, and combinations thereof. In general, preferred thermoplastic polymers of the invention are those having a high melting temperature, e.g. greater than 200° C., more preferably 300° C.; or good heat resistance properties. The organic abrasive particles should have a higher melting or softening point that the moldable polymer, so that the organic particles are not substantially affected by the manufacturing process. The organic particle should be capable of maintaining a generally particulate state during rotary bristle tool processing, and therefore should be selected so as not to substantially melt or soften during the manufacturing process. In one preferred embodiment, the organic particles are selected to provide greater abrasive properties than the moldable polymer, and both the sheath and core, if present. In this manner, the organic abrasive particles will perform the desired surface refinement, such as removing foreign material from the workpiece or providing a fine surface finish, while the moldable polymer wears away during operation to continuously present fresh organic abrasive particles to the workpiece surface.

There are several ways to form a thermoplastic abrasive particle. One such method is to extrude the thermoplastic polymer into elongate segments and then cut these segments into the desired length. Alternatively, the thermoplastic polymer can be molded into the desired shape and particle size. This molding process can be compression molding or injection molding.

The organic abrasive particles can be formed from a thermosetting polymer. Thermosetting polymers can be formed from: phenolic resins, aminoplast resins, urethane resins, epoxy resins, acrylate resins, acrylated isocyanurate resins, ureaformaldehyde resins, isocyanurate resins, acrylated urethane resins, melamine formaldehyde resins, acrylated epoxy resins and mixtures thereof. Phenolic based abrasive particles are one preferred abrasive particles. There are two types of phenolic resins, resole and novolac. Resole phenolic resins have a molar ratio of formaldehyde to phenol, of greater than or equal to one to one, typically between 1.5:1.0 to 3.0:1.0. Novolac resins have a molar ratio of formaldehyde to phenol, of less than to one to one. Examples of commercially available phenolic resins include those known by the tradenames "Durez" and "Varcum" from Occidental Chemicals Co., Burlington, N.J.; "Resinox" from Monsanto; "Aerofene" and "Arotap" from Ashland Chemical Co., Columbus, Ohio. These phenolic resins are cured to thermosetting polymers. The resulting thermosetting polymers are then crushed to the desired particle size and particle size distribution. In alternative method, the thermosetting organic abrasive particles can be made in accordance with the teachings of the U.S. Pat. No. 5,500,273, "Precisely Shaped Particles and Method of Making Same" (Holmes et al.). The organic abrasive particle may be a mixture of a thermoplastic polymer and a thermosetting polymer.

A preferred organic abrasive particle is a metal and mold cleaning plastic blast media available commercially as "MC" blast media from Maxi Blast Inc., South Bend, Indiana, available with an antistatic coating, but preferably untreated. The "MC"media is a 99% melamine formaldehyde cellulosate, an amino thermoset plastic.

The average knoop hardness of the organic abrasive particle is generally less than about 80 KNH, and preferably less than about 65 KNH.

It is also within the scope of this invention to incorporate inorganic based abrasive particles along with the organic abrasive particles. These inorganic abrasive particles typically have a particle size ranging from about 0.01 to 500 micrometers, usually between about 1 to 150 micrometers. In certain cases, it is usually preferred that the inorganic abrasive particles are either the same size or smaller than the organic abrasive particles. It is preferred that the abrasive particles have a Mohs hardness of at least about 7, more preferably above 9. For example, the rotary bristle tool may comprise between 10 to 90% by weight moldable polymer, between 10 to 90% by weight organic abrasive particles and between 0 to 49% by weight inorganic abrasive particles.

When present, the optional abrasive particles 11 are preferably from about 5 to 60 percent by weight of the particle and moldable polymer mixture, and more preferably about 30 to 40 percent, although more or less may be used as desired.

Additives

The moldable polymer 13 may further include optional additives, such as, for example, fillers (including grinding aids), fibers, antistatic agents, antioxidants, processing aids, UV stabilizers, flame retardants, lubricants, wetting agents, surfactants, pigments, dyes, coupling agents, plasticizers and suspending agents. The amounts of these materials are selected to provide the properties desired.

Lubricants

For some refining applications, it is preferred that the moldable polymer 13 include a lubricant. The presence of a lubricant in the moldable polymer 13 reduces the friction of the bristle contacting the workpiece surface. This reduces the heat generated when refining the workpiece. Excessive heat may cause the rotary bristle tool to leave residue on the workpiece or to otherwise harm the workpiece. Suitable lubricants include lithium stearate, zinc stearate, calcium stearate, aluminum stearate, ethylene bis stearamide, graphite, molybdenum disulfide, polytetraflcuroethylene (PTFE), and silicone compounds, for example useful with thermoplastics and thermoplastic elastomers.

An example of a preferred silicone material, which is described in U.S. patent application Ser. No. 08/762,032; entitled "Abrasive Article Having a Bond System Comprising a Polysiloxane" (Barber), filed on Dec. 9, 1996,U.S. Pat. No. 5,849,052, the description of the silicone material being incorporated herein by reference, is a high molecular weight polysiloxane of formula (A):

(A)

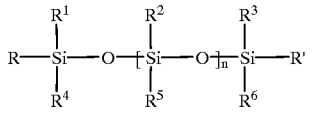

wherein R, R', $R^1$, $R^2$, $R^3$, $R^4$, $R^5$, and $R^6$ may be the same or different and can be an alkyl, vinyl, chloroalkyl, aminoalkyl, epoxy, fluororalkyl, chloro, fluoro, or hydroxy, and n is 500 or greater, preferably 1,000 or greater, more preferably 1,000 to 20,000, and most preferably 1,000 to 15,000.

Another preferred polysiloxane is a polydimethylsiloxane of formula (B):

(B)

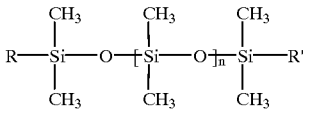

wherein R and R' may be the same or different and can be an alkyl, vinyl, chloroalkyl, aminoalkyl, epoxy, fluororalkyl, chloro, fluoro, or hydroxy, and n is 500 or greater, preferably 1,000 or greater, more preferably 1,000 to 20,000, and most preferably 1,000 to 15,000.

Polysiloxanes are available in many different forms, e.g., as the compound itself or as a concentrate. Example of the polymers into which the polysiloxane can be compounded include polypropylene, polyethylene, polystyrene, polyamides, polyacetal, acrylonitrile-butadiene-styrene (ABS), and polyester elastomer, all of which are commercially available. Silicone modified Hytrel™ is available commercially as BY27-010 (or MB50-010), and silicone modified Nylon 6,6 is available as BY27-005 (or MB50-005), both from Dow Coming Company, Midland, Mich. Typically, commercially available concentrates may contain a polysiloxane at a weight percent ranging from 40 to 50; however, any weight percent is acceptable for purposes of the invention as long as the desired weight percent in the final product can be achieved. Lubricants preferably can be present in the moldable polymer 13 in amounts of up to about 20 percent by weight (exclusive of abrasive particle content), and preferably in an amount from about 1 to 10 percent, although more or less may be used as desired.

Coupling Agent

The moldable polymer 13 may include a coupling agent to improve the bond between the binder and the optional abrasive particles as is known in the art. Examples of such coupling agents suitable for this invention include organo silanes, zircoaluminates and titanates. The abrasive particles 11 may be pretreated with a coupling agent prior to being with the moldable polymer. Alternatively, the coupling agent may be added directly to the moldable polymer 13.

Fillers

The moldable polymer 13 may include a filler as is known in the art. Examples of useful fillers for this invention include: metal carbonates (such as calcium carbonate (chalk, calcite, marl, travertine, marble and limestone), calcium magnesium carbonate, sodium carbonate, magnesium carbonate), silica (such as quartz, glass beads, glass bubbles and glass fibers) silicates (such as talc, clays, (montmorillonite) feldspar, mica, calcium silicate, calcium metasilicate, sodium aluminosilicate, sodium silicate) metal sulfates (such as calcium sulfate, barium sulfate, sodium sulfate, aluminum sodium sulfate, aluminum sulfate, gypsum, vermiculite, wood flour, aluminum trihydrate, carbon black, metal oxides (such as calcium oxide (lime), aluminum oxide, titanium dioxide) and metal sulfites (such as calcium sulfite). Fillers can be used with or without abrasive particles.

Grinding Aids

The moldable polymer may include a grinding aid. A grinding aid is defined herein as particulate material that the addition of which has a significant effect on the chemical and physical processes of abrading which results in improved performance. In particular, it is believed in the art that the grinding aid will either 1) decrease the friction between the abrasive particles and the workpiece being abraded, 2) prevent the abrasive particle from "capping", i.e. prevent metal particles from becoming welded to the tops of the abrasive particles or from re-forming on the workpiece, 3) decrease the interface temperature between the abrasive particles the workpiece, or 4) decreases the grinding forces. Examples of chemical groups of grinding aids include waxes, organic halide compounds, halide salts and metals and their alloys. The organic halide compounds will typically break down during abrading, and release a halogen acid or a gaseous halide compound. Examples of such materials include chlorinated waxes like tetrachloronaphthalene, pentachloronaphthalene; and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metals include, tin, lead, bismuth, cobalt, antimony, cadmium, iron, and titanium. Other miscellaneous grinding aids include sulfur, organic sulfur compounds, graphite and metallic sulfides.

Injection Molding

The rotary bristle tool of the present invention is preferably injection molded. The mold will contain cavities which are the inverse of the desired rotary bristle tool configuration. Thus the mold design must take into account the rotary bristle tool configuration including the size and configuration of the base 12, the bristles 20, and the optional attachment member 50. Preferred methods of making the mold include wire electron discharge machining ("EDM") and plunge EDM.

Figure 16:
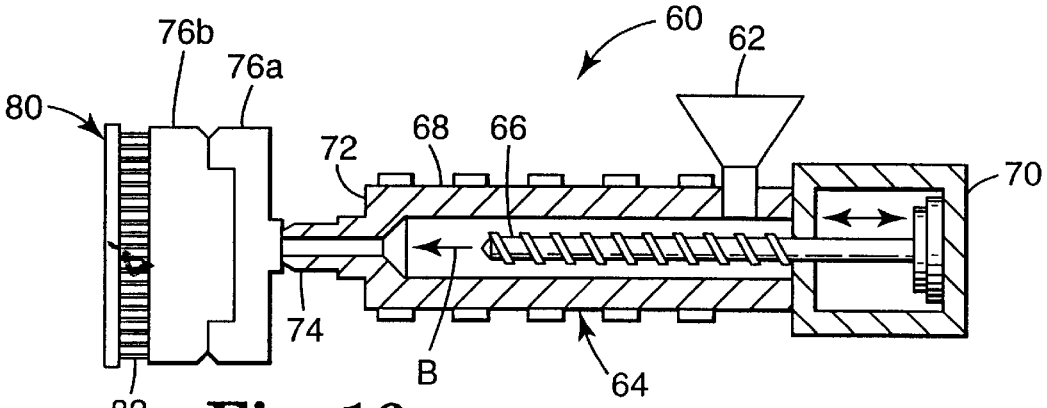
FIG. 16 is a schematic illustration of an apparatus and method for carrying out the present invention.

Injection molding techniques are known in the art. Injection molding apparatus 60 for making the rotary bristle tool 10 according to the method of the present invention is illustrated in FIG. 16. After preferably being dried by heating, a mixture of pellets comprising moldable polymer 13 and, if desired, optional abrasive particles 11, is placed in a hopper 62. The hopper feeds the moldable polymer or moldable polymer/abrasive mixture into a first or rear side 70 of a screw injector 64 generally comprising a screw 66 within a barrel 68. The opposite side, or front side 72 of the screw injector 64 comprises a nozzle 74 for passing the softened material into a mold 76*a*, 76*b*. The barrel 68 of the injector 64 is heated to melt the material, and the rotating screw 66 propels the material in the direction of the nozzle 74. The screw 66 is then moved linearly frontward in direction B to impart the "shot" of the softened material into the mold 76*a*, 76*b* at the desired pressure. A gap is generally maintained between the forward end of the screw and the nozzle to provide a "cushion" area of softened material which is not injected into the mold.

The above mentioned pellets can be preferably prepared as follows. The moldable polymer 13 can be heated above its melting point and the abrasive particles 11, if desired, can then be mixed in. The resulting mixture is then formed into continuous strands and the strands are cooled to solidify the moldable polymer for pelletizing on suitable equipment as is known in the art. Likewise, lubricants and/or other additives to the moldable polymer 13 can be included in the formation of the pellets. The pellets comprising the moldable polymer 13, abrasive particles 11 if desired, and any desired lubricant or other additive are then placed into the hopper 62 to be fed into the screw extruder 64 as described above. Alternatively, it is possible to mix the optional abrasive particles 11, if desired, with pellet form of the moldable polymer 13 and load this in the hopper. Such an alternative method helps minimize wear which could be caused to the equipment used to form the pellet of polymeric material if the abrasive particles are incorporated in the pellets. This alternative method may also result in a stronger rotary bristle tool 10 if the moldable polymer 13 is subject to fewer heat cycles. Likewise, lubricants and/or other additives to the moldable polymer 13 can be mixed in prior to being loaded into the hopper.

The conditions under which the rotary bristle tool is injection molded are determined by the injection molder employed, the configuration of the rotary bristle tool 10, and the composition of the moldable polymer 13 and optional abrasive particles 11. In one preferred method, the moldable polymer 13 is first heated to between 80 to 120° C., preferably 90 to 110° C. for drying, and is placed in the hopper 62 to be gravity fed into the screw feed zone. The barrel temperature of the screw injector is preferably from about 200 to 250° C., more preferably from about 220 to 245° C. The temperature of the mold is preferably from about 50 to 150° C., more preferably from about 100 to 140° C. The cycle time (the time from introducing the mixture into the screw extruder to opening the mold to remove the molded rotary bristle tool) will preferably range between 0.5 to 180 seconds, more preferably from about 5 to 60 seconds. The injection pressure will preferably range from about 690 to 6,900 kPa (100 to 1000 psi), more preferably from about 2070 to 4830 kPa (300 to 700 psi).

The injection mold cycle will depend upon the material composition and the rotary bristle tool configuration. In one preferred embodiment, the moldable polymer and abrasive particles are generally homogenous throughout the rotary bristle tool 10. In such an embodiment, there will be a single insertion or shot of mixture of the moldable polymer 13 and abrasive particle 11 to mold the rotary bristle tool 10, including the base 12, bristles 20, and attachment member 50 if present. Alternatively, the bristles 20 may contain abrasive particles 11, but the base 12 does not. In such an embodiment, there will be two insertions or shots of material. The first insertion will contain a mixture of moldable polymer 13 and abrasive particles 11 to primarily fill the bristle portion of the mold. The second insertion will contain moldable polymer (which may be the same or different from the moldable polymer of the first insertion) without abrasive particles to primarily fill the base and attachment member portions of the mold. Likewise, the base 12 and bristles 20 may contain abrasive particles, but the attachment member 50 may not. In this construction there will be two insertions or shot of material. The first insertion will contain a mixture of moldable polymer 13 and abrasive particles 11 to fill the bristle and base portions of the mold. The second insertion will contain only a moldable polymer (which may be the same or different from the moldable polymer of the first insertion) to primarily fill the attachment member portion of the mold. It is also possible to use more than one shot to vary the color of different portions of the rotary bristle tool if desired. It is also possible to employ three or more shots, for example one each for the bristles, base, and attachment member. After injection molding, the mold is rapidly cooled to solidify the moldable polymer. The mold halves **76*a* and 76*b* are then separated to allow removal of molded rotary bristle tool 10**.

Figure 17:
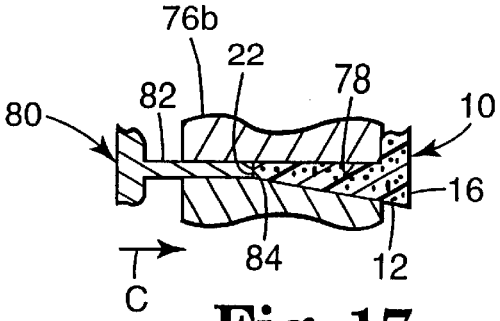
FIG. 17 is a partial cross sectional view of a mold and ejector according to the present invention.

Preferably, an ejector assembly 80 is provided on the opposite side of mold **76*a*, 76*b* from the injection port to eject the solidified rotary bristle tool 10 from the mold. As seen in FIG. 17, ejector pins 82 are preferably located in each mold cavity 78 which corresponds to a bristle 20. After the rotary bristle tool 10 is sufficiently cooled and mold portion 76*a* has been removed, tips 84 of ejector pins 82 are forced to move against the tip 24 of the bristle in direction C towards the base 12, to thereby eject the bristles 20 from their respective cavities. In one preferred embodiment, the location of the tips 84 of ejector pins 82 within the cavity is variable, thereby varying the depth of the mold cavity 78 allowing for longer or shorter bristles 20** to be molded.

This can be done by varying the position of ejector 80 relative to mold portion **76*b*, or by varying the length of the ejector pins 82 on the ejector 80**.

Method of Refining a Surface

As discussed above, the rotary bristle tool 10 according to the present invention is used to refine a surface by: removing a portion of a workpiece surface; imparting a surface finish to a workpiece; cleaning a workpiece surface, including removing paint or other coatings, gasket material, corrosion, or other foreign material; or some combination of the foregoing. The rotary bristle tool 10 is fastened by the attachment member to a suitable power rotary tool, and is particularly well adapted for use with right angle power tools as are known in the art. One suitable power tool for use the rotary bristle tool according to the present invention is the Ingersoll-Rand cyclone series right angle grinder, model TA 180 RG4, rated at 18,000 rpm and 0.70 hp. The rotary bristle tool 10 may mounted by itself on the rotary pover tool, or may employ a back-up pad behind the rotary bristle tool 10 as is known in the art. One suitable back-up pad arrangement is that disclosed in to U.S. Pat. No. 3,562,968 (Johnson et al.), the entire disclosure of which is incorporated herein by reference.

The workpiece can be any type of material such as metal, metal alloys, exotic metal alloys, ceramics, glass, wood, wood-like materials, composites, painted surfaces, plastics, reinforced plastic, stones, and combinations thereof. The workpiece may be flat or may have a shape or contour. Examples of workpieces include glass or plastic eyeglass lenses, other types of glass or plastic lenses, television tubes, metal or other automotive components, particle board, cam shafts, crank shafts, furniture, turbine blades, painted articles including aircraft and automobiles, and the like.

Depending on the application, the force applied with the rotary bristle tool can range from about 0.1 kg to 100 kg. Typically, the force is from about 0.5 to 50 kg. Also depending on the application, there may be a liquid present during use of the rotary bristle tool. This can be water and/or an organic compound, including lubricants, oils, emulsified organic compounds, cutting fluids, soaps, or the like. These liquids may include additives such as defoamers, degreasers, corrosion inhibitors, or the like. The rotary bristle tool may be moved relative to the workpiece in any desired motion, such as rotary or oscillatory motion. In some applications, oscillation may provide a finer surface finish than rotary motion.

The embodiment of FIGS. 1–11 is particularly well suited for refining the inside surface of two-way and three-way corners. For example, it may be desirable to use the rotary bristle tool 10 to refine a weld bead joining two or three plates together at an interior corner. Any power tool capable of driving the rotary bristle tool 10 at sufficient speeds and powers may be used for this application. One nonlimiting example is the Dynabrade Model 50999 Straight Shaft Die Grinder with a ¼ inch collet, capable of 18,000 rpm.

Further details on materials, methods of making, methods of using, and configurations of molded rotary bristle tools are disclosed in U.S. patent application Ser. No. 08/431,910 to Johnson et al., filed Apr. 28, 1995, and in WIPO International Patent Application Publication No. WO 96/33638, the entire contents of both of which are incorporated herein by reference.

All compositions are reported throughout as weight ratios or percent by weight as the case may be, unless otherwise indicated. The percent composition for the components of the moldable polymer is reported based on 100% for the combination of the components of the moldable polymer exclusive of the abrasive particles. The abrasive content is reported as the percent composition of the abrasive particles based on 100% for the combination of the components of the moldable polymer with the abrasive particles.

The present invention has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the invention. For example, the rotary bristle tool according to the present invention may be provided with means for introducing fluid such as coolants, lubricants, and cleaning fluids to the workpiece during operation as is known in the art, such as by openings through the backing or bristles. Thus, the scope of the present invention should not be limited to the exact details and structures described herein, but rather by the structures described by the language of the claims, and the equivalents of those structures.

What is claimed is:

1. A rotary bristle tool, comprising:

a base including a first side, a second side, a center of rotation, and a peripheral edge; and an array of bristles extending from said first side of said base, wherein each of said bristles includes a root adjacent said base within the area defined by said peripheral edge and a tip opposite said root and remote from said base, and wherein said bristles comprise an elastomeric polymer;

wherein said array of bristles defines an array root outer diameter at said roots of said bristles and an array tip outer diameter at said tips of said bristles, and wherein the ratio of said array root outer diameter to said array tip outer diameter is at least 2:1.

2. The rotary bristle tool of claim 1, wherein said array is circular, and wherein said array root and tip outer diameters are concentric with said base center of rotation.

3. The rotary bristle tool of claim 2, further comprising attaching means, centered on said base center of rotation, for attaching said tool to a drive member.

4. The rotary bristle tool of claim 3, wherein said attaching means comprises a mounting hole extending through said base.

5. The rotary bristle tool of claim 1, wherein said bristles include a plurality of abrasive particles therein.

6. The rotary bristle tool of claim 1, wherein said bristles include a root cross section and a tip cross section;

wherein said root cross section includes a root major thickness and a root minor thickness, and wherein the ratio of said root major thickness to said root minor thickness is at least 2:1; and wherein said root major thickness is oriented at an angle of from −20° to +20° relative to a line extending from said base center of rotation to said root.

7. The rotary bristle tool of claim 6, wherein said root major thickness is oriented along a line extending from said base center of rotation to said root.

8. The rotary bristle tool of claim 6, wherein said bristles have a bristle length from said root to said tip, and wherein the ratio of said bristle length to said root minor thickness is at least 5:1.

9. The rotary bristle tool of claim 6, wherein said tip cross section has a tip major thickness and a tip minor thickness smaller than said tip major thickness.

10. The rotary bristle tool of claim 9, wherein said tip major thickness is parallel to said root major thickness.

11. The rotary bristle tool of claim 1, wherein said bristles comprise a thermoplastic elastomer.

12. The rotary bristle tool of claim 1, wherein said bristles are integrally molded with said base.

13. The rotary bristle tool of claim 12, wherein said bristles and base comprise a thermoplastic elastomer.

14. The rotary bristle tool of claim 1, wherein said bristle array further defines an array inner diameter of up to 1.0 cm.

15. The rotary bristle tool of claim 1, wherein said array further defines an array inner diameter, and wherein said array inner diameter is substantially constant along the length of said bristles.

16. A rotary bristle tool, comprising:

a base including a first side, a second side, and a center of rotation; and an array of bristles extending from said first side of said base, wherein each of said bristles includes a root adjacent said base and a tip opposite said root, and wherein said bristles comprise an elastomeric polymer;

wherein said array of bristles defines an array root outer diameter at said roots of said bristles and an array tip outer diameter at said tips of said bristles, and wherein the ratio of said array root outer diameter to said array tip outer diameter is at least 2:1;

wherein said bristles include a root cross section and a tip cross section;

wherein said root cross section includes a root major thickness and a root minor thickness, and wherein the ratio of said root major thickness to said root minor thickness is at least 2:1;

wherein said root major thickness is oriented at an angle of from −20° to +20° relative to a line extending from said base center of rotation to said root; and wherein said tip cross section is circular.

17. A rotary bristle tool, comprising:

a base including a first side, a second side, and a center of rotation; and an array of bristles extending from said first side of said base, wherein each of said bristles includes a root adjacent said base and a tip opposite said root, and wherein said bristles comprise an elastomeric polymer;

wherein said array of bristles defines an array root outer diameter at said roots of said bristles and an array tip outer diameter at said tips of said bristles, and wherein the ratio of said array root outer diameter to said array tip outer diameter is at least 2;1;

wherein said bristles include a root cross section and a tip cross section;

wherein said root cross section includes a root major thickness and a root minor thickness, and wherein the ratio of said root major thickness to said root minor thickness is at least 2:1;

wherein said root major thickness is oriented at an angle of from −20° to +20° relative to a line extending from said base center of rotation to said root;

wherein said bristles have a bristle length from said root to said tip, and wherein the ratio of said bristle length to said root minor thickness is at least 5:1; and wherein said bristles are configured such that rotation of said rotary bristle tool about said base center of rotation at 1000 RPM causes said bristles to deflect such that the ratio of said array tip outer diameter to said array root outer diameter is at least 1:1.

18. A rotary bristle tool, comprising:

a base including a first side, a second side, and a center of rotation; and an array of bristles extending from said first side of said base, wherein each of said bristles includes a root adjacent said base and a tip opposite said root, and wherein said bristles comprise an elastomeric polymer;

wherein said array of bristles defines an array root outer diameter at said roots of said bristles and an array tip outer diameter at said tips of said bristles, and wherein the ratio of said array root outer diameter to said array tip outer diameter is at least 2:1;

wherein said bristles include a root cross section and a tip cross section;

wherein said root cross section includes a root major thickness and a root minor thickness, and wherein the ratio of said root major thickness to said root minor thickness is at least 2:1;

wherein said root major thickness is oriented at an angle of from −20° to +20° relative to a line extending from said base center of rotation to said root;

wherein said bristles have a bristle length from said root to said tip, and wherein the ratio of said bristle length to said root minor thickness is at least 5:1; and wherein said bristles are configured such that rotation of said rotary bristle tool about said base center of rotation at 3000 RPM causes said bristles to deflect such that the ratio of said array tip outer diameter to said array root outer diameter is at least 1.5:1.

19. A rotary bristle tool, comprising:

a base including a first side, a second side, and a center of rotation; and an array of bristles extending from said first side of said base, wherein each of said bristles includes a root adjacent said base and a tip opposite said root, and wherein said bristles comprise an elastomeric polymer;

wherein said array of bristles defines an array root outer diameter at said roots of said bristles and an array tip outer diameter at said tips of said bristles, and wherein the ratio of said array root outer diameter to said array tip outer diameter is at least 2:1;

wherein said bristles include a root cross section and a tip cross section;

wherein said root cross section includes a root major thickness and a root minor thickness, and wherein the ratio of said root major thickness to said root minor thickness is at least 2:1;

wherein said root major thickness is oriented at an angle of from −20° to +20° relative to a line extending from said base center of rotation to said root;

wherein said bristles have a bristle length from said root to said tip, and wherein the ratio of said bristle length to said root minor thickness is at least 5:1; and wherein said bristles are configured such that rotation of said rotary bristle tool about said base center of rotation at 2000 RPM causes said bristles to deflect such that the ratio of said array tip outer diameter during rotation to said array tip diameter at rest is at least 1.5:1.

20. A rotary bristle tool, comprising:

a base including a first side, a second side, and a center of rotation; and an array of bristles extending from said first side of said base, wherein each of said bristles includes a root adjacent said base and a tip opposite said root and wherein said bristles comprise an elastomeric polymer;

wherein said array of bristles defines an array root outer diameter at said roots of said bristles and an array tip outer diameter at said tips of said bristles, and wherein the ratio of said array root outer diameter to said array tip outer diameter is at least 2:1;

wherein said bristles include a root cross section and a tip cross section;

wherein said root cross section includes a root major thickness and a root minor thickness, and wherein the ratio of said root major thickness to said root minor thickness is at least 2:1;

wherein said root major thickness is oriented at an angle of from −20° to +20° relative to a line extending from said base center of rotation to said root;

wherein said bristles have a bristle length from said root to said tip, and wherein the ratio of said bristle length to said root minor thickness is at least 5:1; and wherein said bristles are configured such that upon rotation of said rotary bristle tool about said base center of rotation at a sufficiently high rotational speed to cause said bristles to deflect such that said array tip outer diameter under rotation is at least two times said array tip outer diameter at rest, the tangential component of deflection at said tips is greater than the radial component of deflection at said tips.

21. The rotary bristle tool of claim 20, wherein upon rotation of said rotary bristle tool at said sufficiently high rotational speed, the ratio of the tangential component of deflection at said tips to the radial component of deflection at said tips is at least 3:1.

22. A rotary bristle tool, comprising:

a base including a first side, a second side, and a center of rotation; and an array of bristles extending from said first side of said base, wherein each of said bristles includes a root adjacent said base and a tip opposite said root, and wherein said bristles comprise an elastomeric polymer;

wherein said array of bristles defines an array root outer diameter at said roots of said bristles and an array tip outer diameter at said tips of said bristles, and wherein the ratio of said array root outer diameter to said array tip outer diameter is at least 2:1;

wherein said array is circular, and wherein said array root and tip outer diameters are concentric with said base center of rotation;

further comprising attaching means, centered on said base center of rotation, for attaching said tool to a drive member;

wherein said attaching means comprises an attachment member extending from said second side of said base.

23. The rotary bristle tool of claim 22, wherein said attachment member comprises a threaded stud.

24. A rotary bristle tool, comprising:

a base including a first side, a second side, a center of rotation, and a peripheral edge; and a plurality of bristles extending from said first side of said base, wherein said bristles comprise a moldable polymer;

wherein each of said bristles includes a root adjacent said base within the area defined by said peripheral edge, a tip opposite said root and remote from said base, and a length from said root to said tip, and wherein said bristles include a root cross section and a tip cross section;

wherein said root cross section includes a root major thickness and a root minor thickness, wherein the ratio of said root major thickness to said root minor thickness is at least 1.5:1, and wherein said root major thickness is oriented at an angle of from −20° to +20° relative to a line extending from said base center of rotation to said root; and wherein the ratio of said bristle length to said root major thickness is at least 5:1.

25. The rotary bristle tool of claim 24, wherein said bristles include a plurality of abrasive particles therein.

26. The rotary bristle tool of claim 24, further comprising attaching means, centered on said base center of rotation, for attaching said tool to a drive member.

27. The rotary bristle tool of claim 26 wherein said attaching means comprises a mounting hole extending through said base.

28. The rotary bristle tool of claim 24, wherein said moldable polymer comprises an elastomeric polymer.

29. The rotary bristle of tool 24, wherein said moldable polymer comprises a thermoplastic elastomer.

30. The rotary bristle of tool 24, wherein said bristles are integrally molded with said base.

31. The rotary bristle of tool 30, wherein said bristles and base comprise an elastomeric polymer.

32. The rotary bristle of tool 31, wherein said bristles and base comprise a thermoplastic elastomer.

33. A rotary bristle tool, comprising:

a base including a first side, a second side, and a center of rotation; and a plurality of bristles extending from said first side of said base, wherein said bristles comprise a moldable polymer;

wherein each of said bristles includes a root adjacent said base, a tip opposite said root, and a length from said root to said tip, and wherein said bristles include a root cross section and a tip cross section;

wherein said root cross section includes a root major thickness and a root minor thickness, wherein the ratio of said root major thickness to said root minor thickness is at least 1.5:1, and wherein said root major thickness is oriented at an angle of from −20° to +20° relative to a line extending from said base center of rotation to said root;

wherein the ratio of said bristle length to said root major thickness is at least 5:1;

wherein said bristles include an inboard side facing said base center of rotation, an outboard side facing away from said b ase center of rotation, rind first and second sides opposite to one another and extending from said inboard side to said outboard side; and wherein, at least at said bristle root, said inboard side has a first radius of curvature and said outboard side has a second radius of curvature, wherein the ratio of said first radius of curvature to said second radius of curvature is at least 2:1.

34. The rotary bristle tool of claim 33, wherein there is a smooth transition from said inboard side to said first and second sides and from said outboard side to said first and second sides.

35. A rotary bristle tool, comprising:

a base including a first side, a second side, and a center of rotation; and a plurality of bristles extending from said first side of said base, wherein said bristles comprise a moldable polymer;

wherein each of said bristles includes a root adjacent said base, a tip opposite said root, and a length from said root to said tip, and wherein said bristles include a root cross section and a tip cross section;

wherein said root cross section includes a root major thickness and a root minor thickness, wherein the ratio of said root major thickness to said root minor thickness is at least 1.5:1, and wherein said root major thickness is oriented at an angle of from −20° to +20° relative to a line extending front said base center of rotation to said root; and wherein the ratio of said bristle length to said root major thickness is at least 5:1; and wherein said tip cross section is circular.

36. A rotary bristle tool, comprising:

a base including a first side, a second side, and a center of rotation; and a plurality of bristles extending from said first side of said base, wherein said bristles comprise a moldable polymer;

wherein each of said bristles includes a root adjacent said base, a tip opposite said root, and a length from said root to said tip, and wherein said bristles include a root cross section and a tip cross section;

wherein said root cross section includes a root major thickness and a root minor thickness, wherein the ratio of said root major thickness to said root minor thickness is at least 1.5:1, and wherein said root major thickness is oriented at an angle of from −20° to +20° relative to a line extending from said base center of rotation to said root;

wherein the ratio of said bristle length to said root major thickness is at least 5:1;

further comprising attaching means, centered on said base center of rotation, for attaching said tool to a drive member;

wherein said attaching means comprises an attachment member extending from said second side of said base.

37. The rotary bristle tool of claim 36, wherein said attachment member comprises a threaded stud.

38. A rotary bristle tool, comprising:

a base including a first side, a second side, and a center of rotation; and an array of bristles extending from said first side of said base, wherein said bristles comprise a moldable elastomeric polymer;

wherein each of said bristles includes a root adjacent said base, a tip opposite said root, and a length from said root to said tip, wherein said root includes a root cross section including a root major thickness and a root minor thickness, and wherein the ratio of said bristle length to said root minor thickness is at least 4:1;

wherein said array defines an array tip outer diameter at said tips of said bristles; and wherein said bristles are configured such that upon rotation of said rolary bristle tool about said base center of rotation at a sufficiently high rotational speed to cause said bristles to deflect to an array tip outer diameter under rotation that is at least two times said array tip outer diameter at rest, the ratio of the tangential component of deflection to the radial component of deflection is at least 3:1.

39. The rotary bristle tool of claim 38, wherein said array of bristles further defines an array root outer diameter at said roots of said bristles and wherein the ratio of said array root outer diameter to said array tip outer diameter is at least 2:1.

40. The rotary bristle tool of claim 39, wherein said array is circular and wherein said root and tip outer diameters are concentric with said base center of rotation.

41. The rotary bristle tool of claim 38, wherein the ratio of said root major thickness to said root minor thickness is at least 2:1; and wherein said root major thickness is oriented at an angle of from −20° to +20° relative to a line extending from said base center of rotation to said root.

42. The rotary bristle tool of claim 41, wherein said root major thickness is oriented along a line extending from said base center of rotation to said root.

43. The rotary bristle tool of claim 41, wherein said tip includes a tip cross section including a tip major thickness and a tip minor thickness, and wherein the ratio of said tip major thickness to said tip minor thickness is from 1:1 to 1.5:1.

44. The rotary bristle tool of claim 43, wherein said tip major thickness is parallel to said root major thickness.

45. The rotary bristle tool of claim 43, wherein said tip cross section is circular.

46. The rotary bristle tool of claim 38, wherein said bristles are configured such that rotation of said rotary bristle tool about said base center of rotation at 1000 RPM causes said bristles to deflect such that the ratio of said array tip outer diameter under rotation to said array tip outer diameter at rest is at least 1.5:1.

47. The rotary bristle tool of claim 38, further comprising attaching means, centered on said base center of rotation, for attaching said tool to a drive member.

48. The rotary bristle tool of claim 47, wherein said attaching means comprises a mounting hole extending through said base.

49. The rotary bristle tool of claim 47, wherein said attaching means comprises an attachment member extending from said second side of said base.

50. The rotary bristle tool of claim 49, wherein said attachment member comprises a threaded stud.

51. The rotary bristle of tool 38, wherein said bristles comprise a thermoplastic elastomer.

52. The rotary bristle of tool 38, wherein said bristles are integrally molded with said base.

53. The rotary bristle of tool 52, wherein said bristles and base comprise a thermoplastic elastomer.

54. The rotary bristle tool of claim 38, wherein said bristle array further defines an array inner diameter of up to 1.0 cm.

55. The rotary bristle tool of claim 38, wherein said array further defines an array inner diameter, and wherein said array inner diameter is substantially constant along the length of said bristles.

* * * * *